US006746181B1

(12) United States Patent
Heintz et al.

(10) Patent No.: US 6,746,181 B1
(45) Date of Patent: Jun. 8, 2004

(54) AUTOMATED DOCK REMOVAL AND REPLACEMENT SYSTEM AND METHODS OF CONSTRUCTING AND OPERATING THE SYSTEM

(75) Inventors: Gregory P. Heintz, 525 S. Clare Ave., Harrison, MI (US) 48625; Thomas L. Johnson, Weidman, MI (US)

(73) Assignee: Gregory P. Heintz, Harrison, MI (US)

( * ) Notice: Subject to any disclaimer, the term of this patent is extended or adjusted under 35 U.S.C. 154(b) by 0 days.

(21) Appl. No.: 10/066,857

(22) Filed: Feb. 4, 2002

Related U.S. Application Data

(60) Provisional application No. 60/266,564, filed on Feb. 5, 2001.

(51) Int. Cl.[7] ..... E02B 3/20

(52) U.S. Cl. ..... 405/219; 405/2; 405/221; 114/263

(58) Field of Search ..... 405/1–2, 218–221; 114/263–267

(56) References Cited

U.S. PATENT DOCUMENTS

| | | | | | |
|---|---|---|---|---|---|
| 2,948,121 | A | * | 8/1960 | Karst | 405/220 |
| 3,686,876 | A | * | 8/1972 | Muschell | 405/220 |
| 4,352,597 | A | * | 10/1982 | Kay | 405/219 |
| 4,505,619 | A | * | 3/1985 | Sargent | 405/220 |
| 4,645,380 | A | * | 2/1987 | Hambrick et al. | 405/220 |
| 4,979,453 | A | * | 12/1990 | Sloan et al. | 114/263 |

* cited by examiner

*Primary Examiner*—Heather Shackelford
*Assistant Examiner*—Sunil Singh
(74) *Attorney, Agent, or Firm*—Reising, Ethington, Barnes, Kisselle & Learman, P.C.

(57) ABSTRACT

A dock system comprises a shore base with a train of disengageable dock module components comprising floatable modules with connector assemblies for releasably connecting the modules. The system includes laterally spaced posts, with lake bed engaging dock supporting base parts. The module components are vertically slidably on the posts to move from a lower floating position to a raised position safely above the water. A module transport device is operable to move the modules sequentially forwardly to form a train as the modules are sequentially connected or to move the modules sequentially rearwardly to remove them to shore as the modules are sequentially unlocked.

23 Claims, 22 Drawing Sheets

FIG - 17
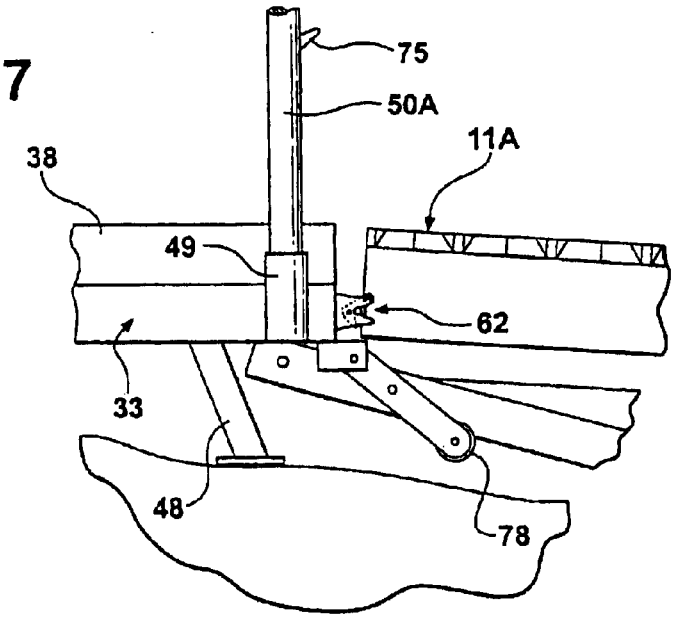
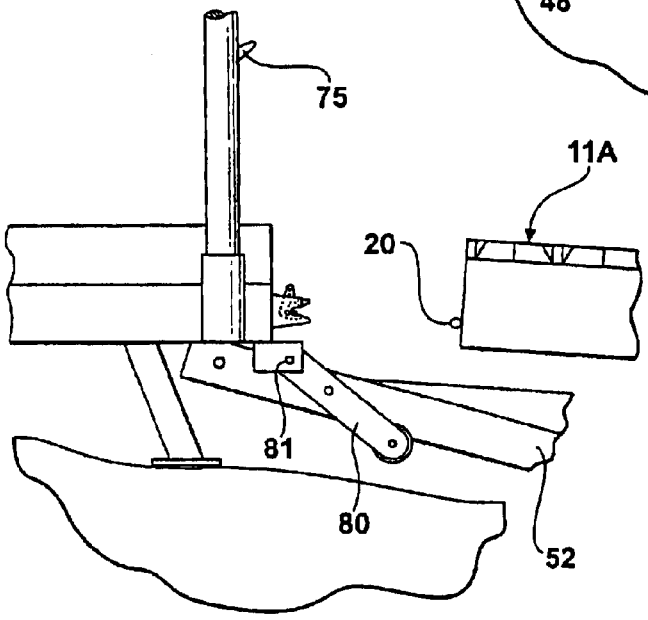
FIG - 18
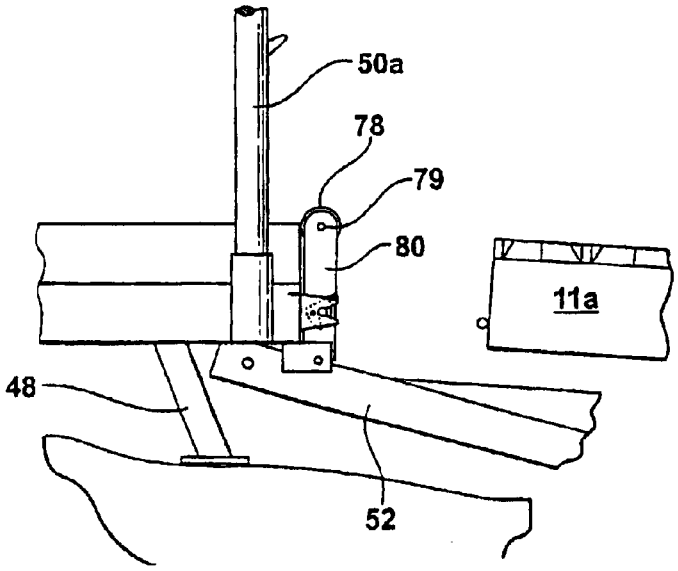
FIG - 19

AUTOMATED DOCK REMOVAL AND REPLACEMENT SYSTEM AND METHODS OF CONSTRUCTING AND OPERATING THE SYSTEM

This application claims the priority of provisional application Serial No. 60/266,564 filed Feb. 5, 2001.

The present system is directed to modular docks which extend from the shore a substantial distance out into the water and, more particularly, to an automated dock system which is operable to be placed in position from a storage location and to be retrieved therefrom.

BACKGROUND OF THE INVENTION

Modular dock sections which are releasably connected together and can be supported above water level by poles or other supports extending down to the bottom of a lake or other body of water are, of course, well known. Characteristic of such docks is the necessity to enter the water in frigid water conditions to install the dock in operative position and then, later, to seasonally dismantle it to prevent its being destroyed by ice or weather conditions.

The present system is designed to permit one person, or several persons, to both place the dock in operative position and, when desired, to remove it to storage position without necessitating that the person involved enter the water and assume the risk of hypothermia and its attendant health problems.

It is further designed to permit a dock to be set up or withdrawn in a rapid and easy manner using apparatus which can be purchased and maintained economically.

SUMMARY OF THE INVENTION

In its preferred form, the invention is concerned with a shore-based platform or the like on which dock modules or sections are received. In the water, the dock modules are connected by releasable locking mechanisms which can be sequentially disengaged for purposes of dock disassembly and retrieval as a drive mechanism brings the dock modules in a train sequentially to the platform upon which the dock modules are to be received. The modules can be supported in the water on poles which are removable when the locking mechanisms are released. When the dock is to be replaced, the dock modules are moved sequentially away from the platform once the dock locking mechanisms are sequentially engaged. The dock sections can float until they are raised to a predetermined level above the water.

A prime object of the invention is to provide an automated assembly useful in both placing the dock in position at the beginning of the season and then returning it to shore after the season.

Another object of the invention is to provide an assembly of the character described which effectually extends the season of dock use.

A further object of the invention is to provide a readily handled, lightweight dock assembly which is durable in use and does not require substantial maintenance.

Still another object of the invention is to provide new methods of operating and constructing docks.

Other objects and advantages of the invention will become apparent with reference to the accompanying drawings and the accompanying descriptive matter.

THE DRAWINGS

The presently preferred embodiment of the invention is disclosed in the following description and in the accompanying drawings, wherein:

FIG. 17 is a reduced size fragmentary schematic side elevational view illustrating the inoperative position of the dock lifting arm provided at the front end of the loading-unloading platform and showing the adjacent dock section locked to the front end of the loading-unloading platform;

FIG. 18 schematically shows the same parts with the adjacent dock section unlocked from the loading-unloading platform and backed off;

FIG. 19 is a similar schematic view showing the dock lift arms swung up to locked position;

FIG. 20 is a similar schematic view showing the lock lift arm supporting rollers in engagement with a dock section as it is moved onto the loading platform;

FIG. 21 is an enlarged fragmentary schematic view illustrating the spring clamp members which hold the dock lock bridging covers in releasable position;

Figure 22:
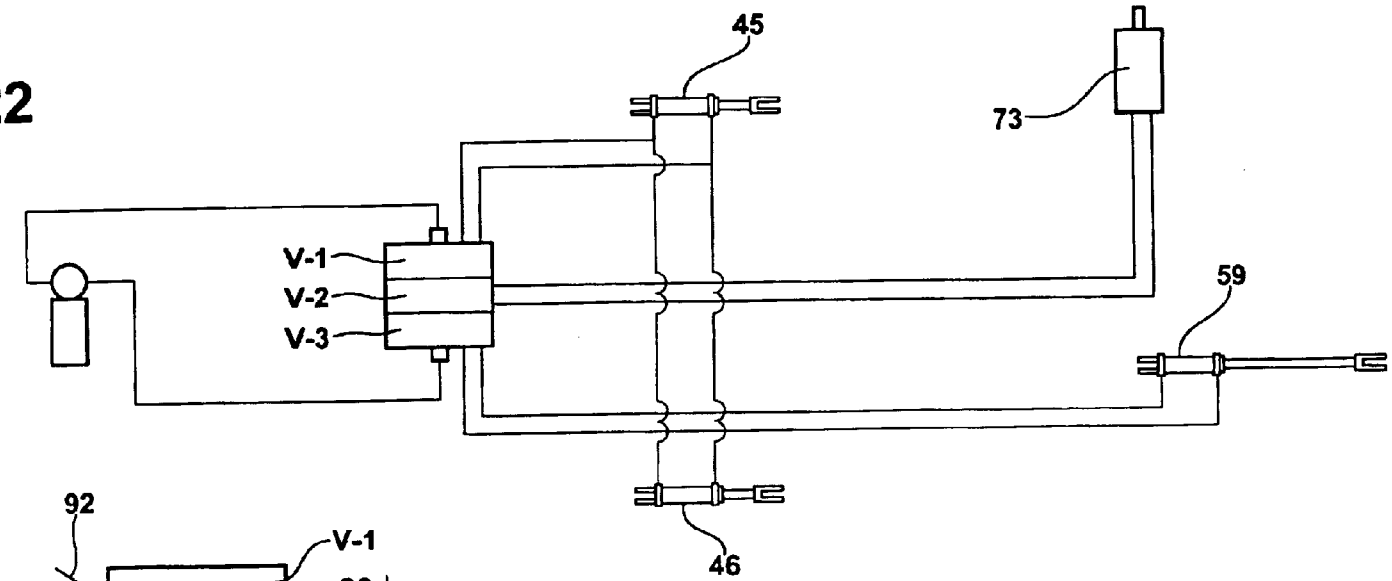
Figure 22A:
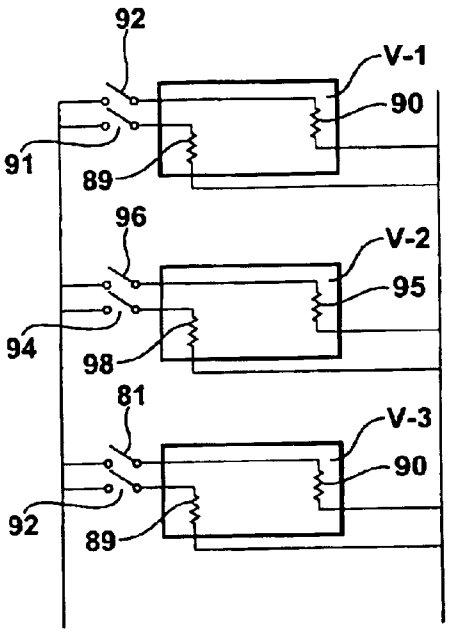
Figure 23:
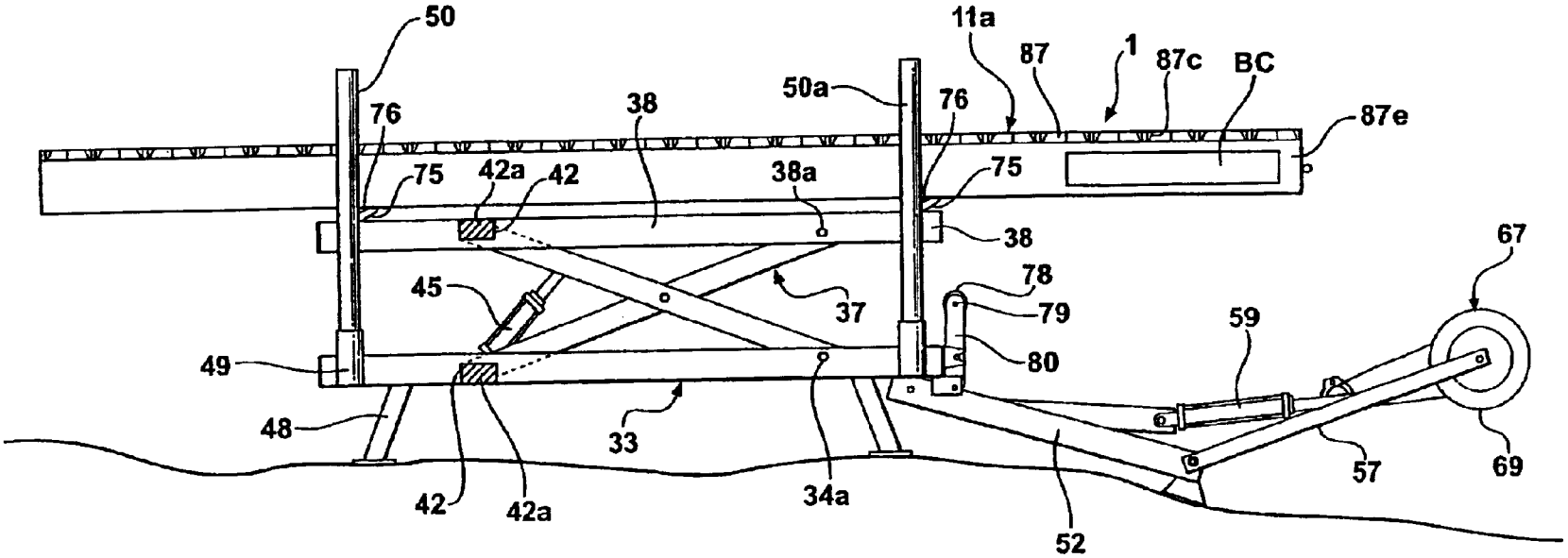
Figure 25:
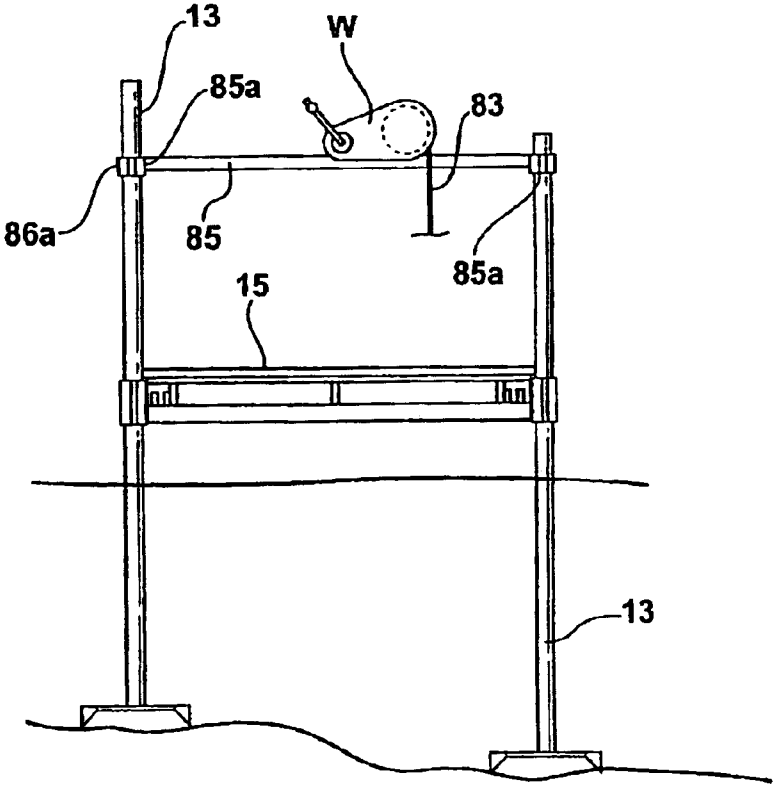
Figure 24:
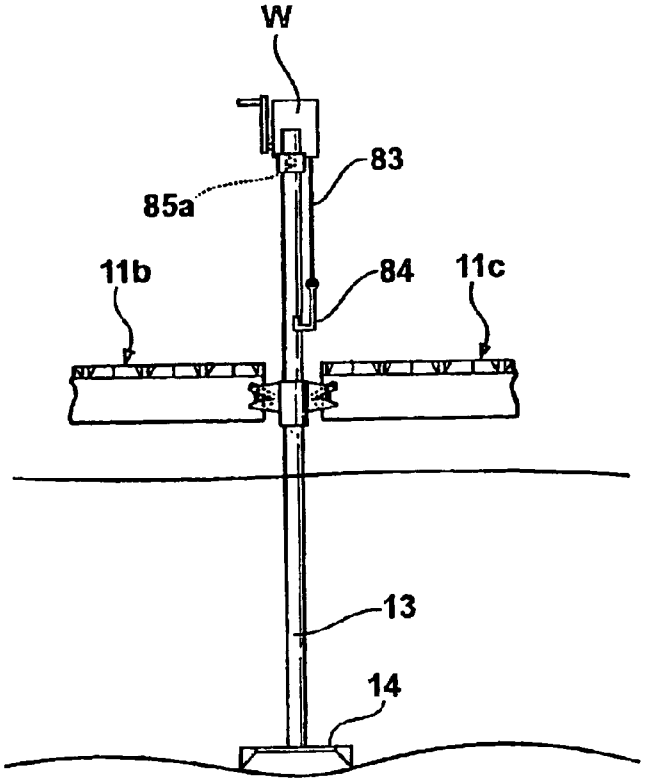

FIG. 22 schematically discloses an electro-hydraulic control system which can be employed;

FIG. 22A schematically portrays a typical electrical control circuit;

FIG. 23 is an enlarged fragmentary, schematic side elevational view illustrating the loading-unloading platform lifting mechanism preferred;

FIG. 24 is an enlarged fragmentary, schematic side elevational view showing a winch in position on a connector; and FIG. 25 is a schematic end elevational view thereof.

DETAILED DESCRIPTION

Figure 1:
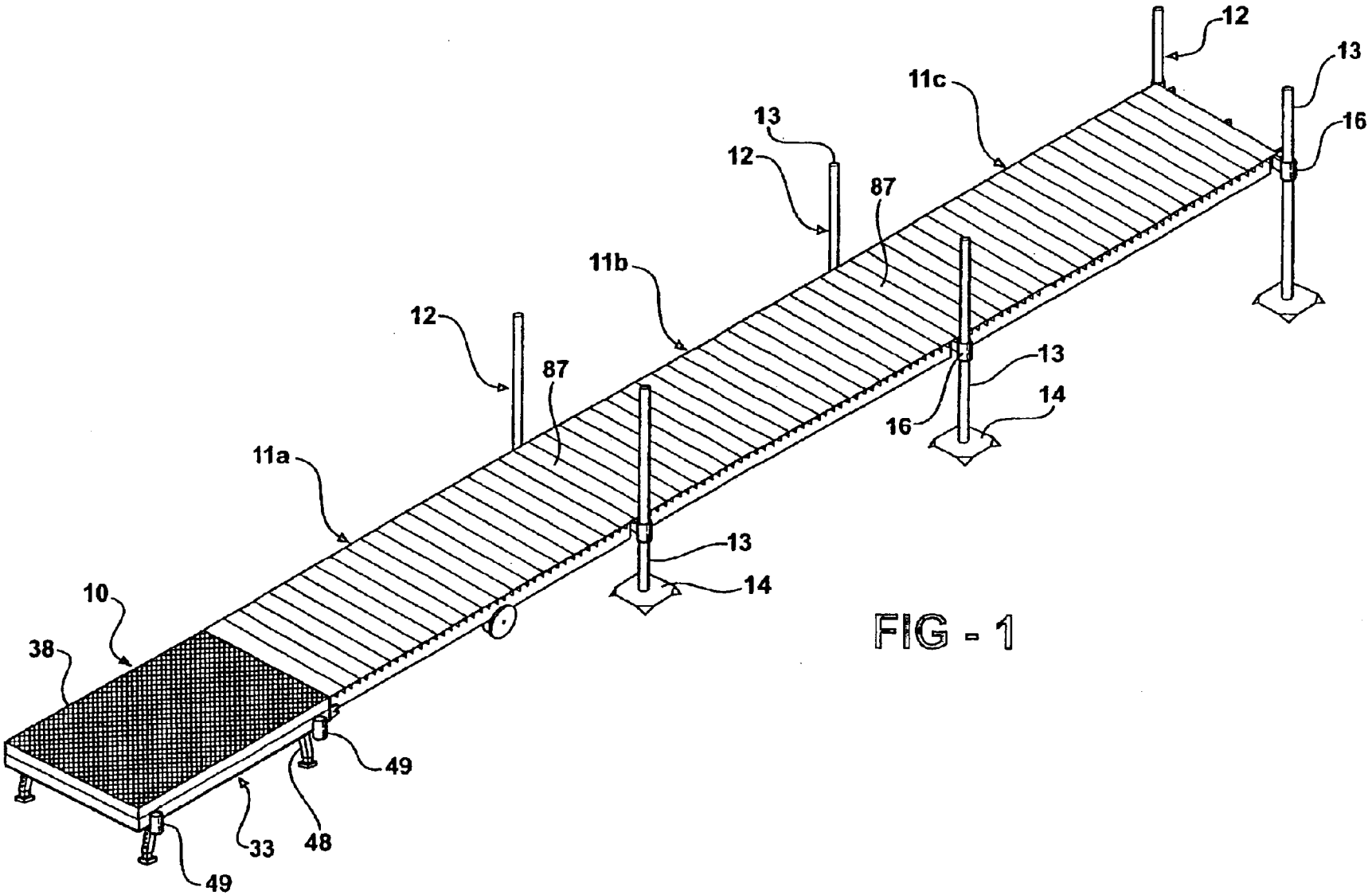
FIG. 1 is a schematic, perspective plan view of the dock as it would appear when in use.

Referring now, more particularly, to the accompanying drawings, wherein FIG. 1 illustrates the dock in installed position, it is to be understood that the dock illustrated is a modular dock comprised of a shore base or station, generally designated 10, releasably connected with a series of dock sections or modules 11*a*, 11*b*, and 11*c* which are themselves releasably connected together in a manner which will be illustrated presently. While three dock sections are shown and it is contemplated they will be individually ten feet in length, other numbers of sections may be utilized dependant on the length of dock desired.

Figure 7:
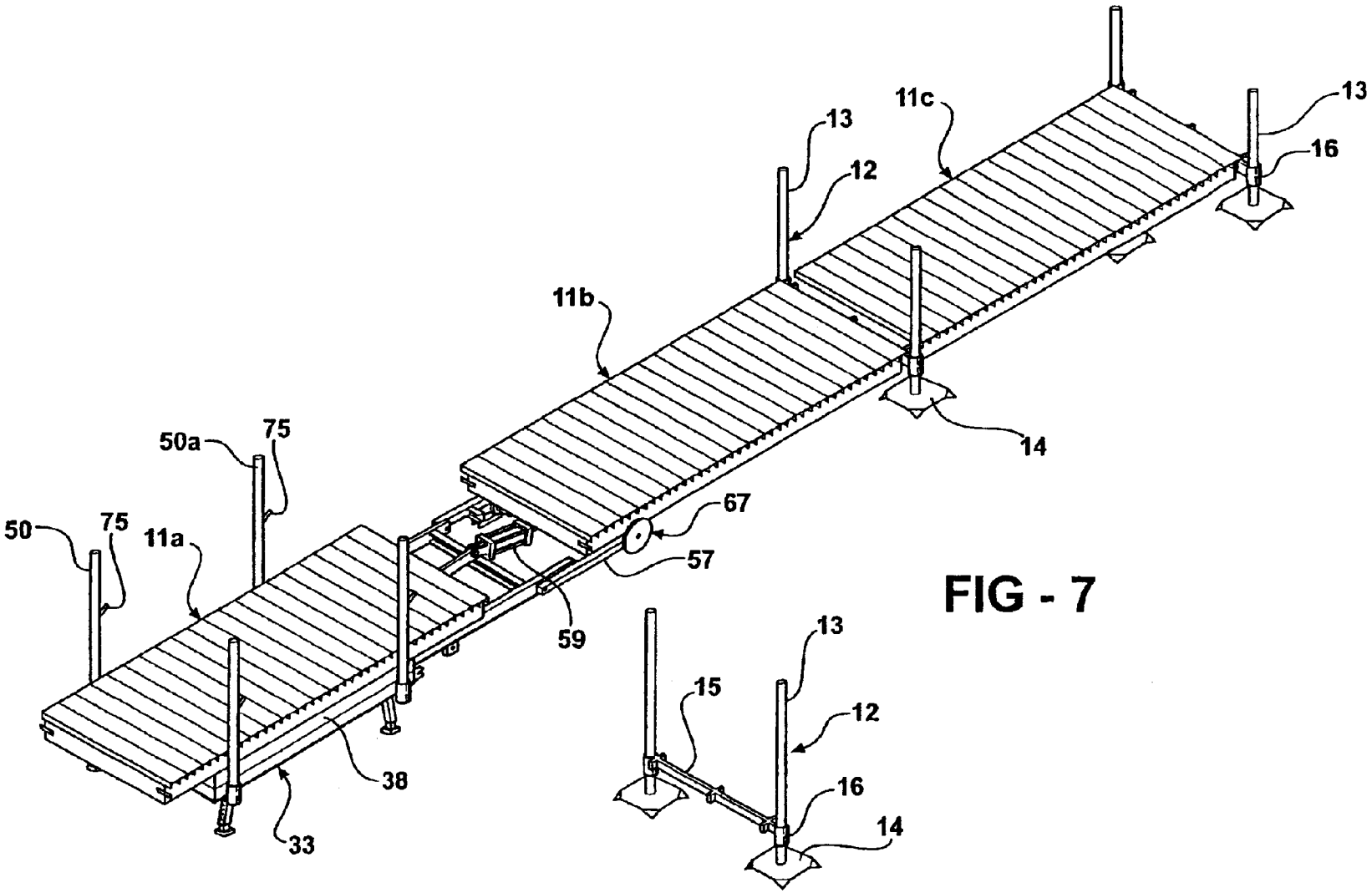
FIG. 7 is a schematic view similar to FIG. 6 showing the deck connector assembly removed.

Between each of the dock sections is a dock section connector or support assembly, generally designated 12, which is shown in FIG. 7, for example, as having been removed from between the dock sections. The dock modules 11*a*, 11*b*, and 11*c* and their end connector assemblies may be collectively referenced as dock module components. Each connector 12 carries dock supporting poles or stanchions 13 supported by bottom plates 14 or in some other practical fashion. In sandy soil, the poles 13 may be provided with auger configurations at their lower ends so that they can simply be screwed into the bottom soil. The stanchions 13 are slideably connected to a crossbar 15 in a manner so that the crossbar 15 will permit the pole or stanchions 13 to either remain fixed in position, or be slideably movable upwardly and downwardly.

Figure 12:
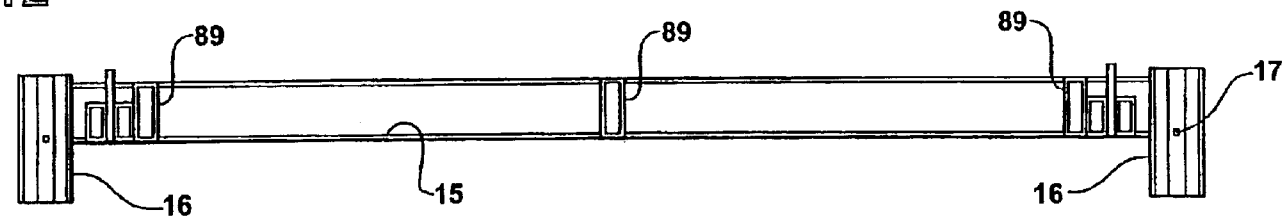
FIG. 12 is an enlarged schematic elevational view illustrating the crossbar of the connector assembly.
Figure 13:
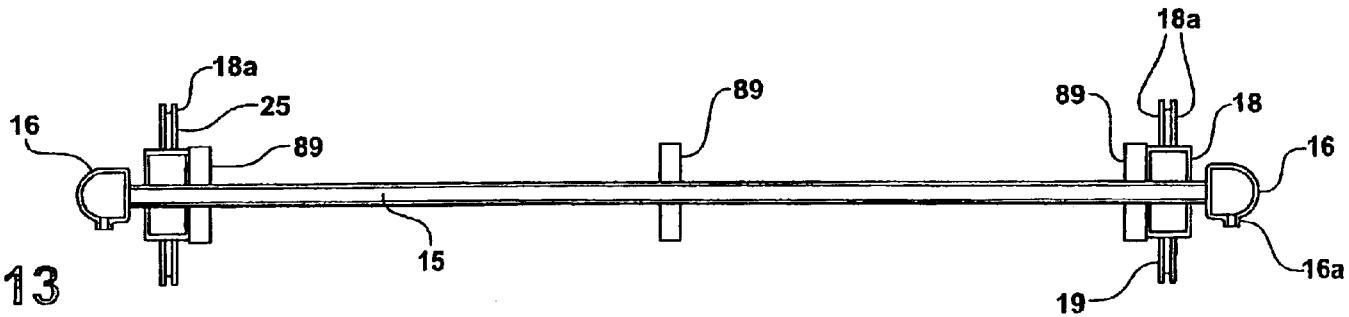
FIG. 13 is a schematic top plan view thereof.
Figure 14:
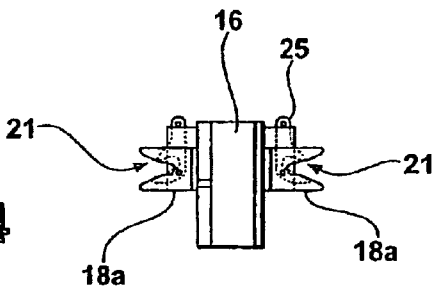
FIG. 14 is a schematic end elevational view thereof.

When in position, the dock sections 11 are releasably locked together via the connector assemblies 12 in a manner which permits each to vertically tilt with respect to the other to a limited degree for purposes which will be presently described. The connector crossbars or rails 15 are more particularly illustrated in FIGS. 12–14. Each is shown as having a sleeve 16 at each of its ends for the telescopic reception of one of the stanchions 13. Each sleeve 16 has a threaded fitting 16*a* for reception of a disengageable mechanism such as set bolt 17 which releasably fixes the vertical position of the stanchions 13.

Figure 16:
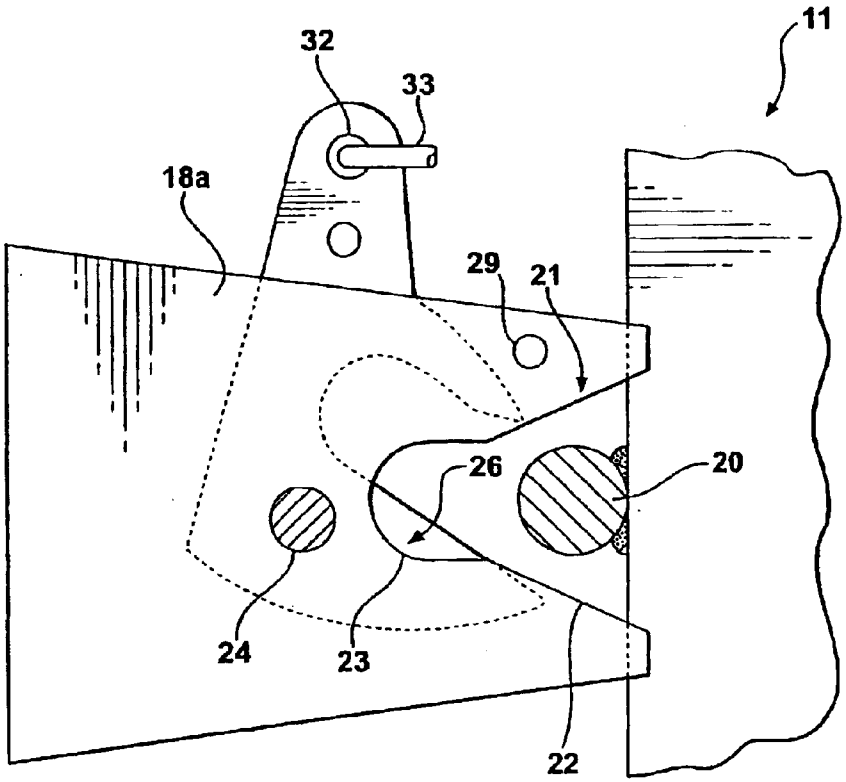
FIG. 16 is a similar schematic view with the lock member in disengaged position.
Figure 15:
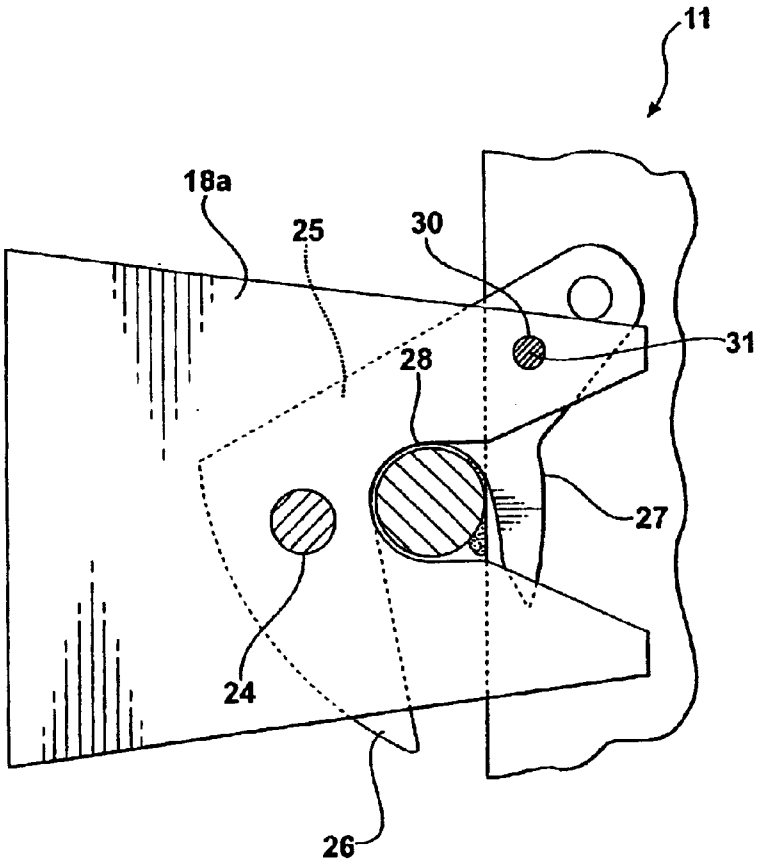
FIG. 15 is a greatly enlarged, schematic side elevational view showing the releasable lock system for both releasably connecting the loading platform unit to the adjacent dock section and for connecting the dock section connectors with the docks.
Figure 20:
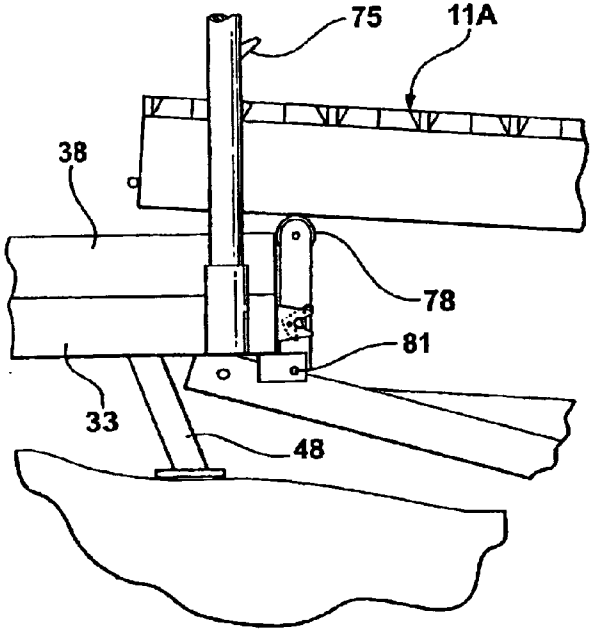

Mounted laterally inboard of each connector sleeve 16, on the front and rear sides thereof on frames 18, are lock assemblies or lock elements, generally designated 19, which are, more particularly, illustrated in FIGS. 15 and 16. The same locking system 19 is provided on the front end of frame 33. It will be noted that the dock sections 11*a*, 11*b*, and 11*c* are also provided with locking elements in the form of lock pins 20 (FIG. 16) projecting laterally from each side of the dock at the front and rear ends thereof, which are each receivable within a camming recess, generally designated 21, provided in a pair of laterally spaced plates or legs forming jaws 18*a* forming a part of the member 18 at each end thereof forwardly and rearwardly. The recesses 21 include piloting inclined surfaces 22 joining to socket portions 23 within which the laterally projection pins 20 can be received as shown in FIG. 15. Pivoted between and to the jaws 18*a*, as with pins 24, are lock or latch members 25. Each lock member 25, as shown in FIGS. 15 and 16, has projecting spaced apart locking legs 26 and 27 extending from a socket portion 28. In disengaged position each leg 26 is in the path of the dock locking projection 20 as shown in FIG. 16 so that, when the projection 20 enters the recess 21 under the operation of drive units 67, the lock members 25 are automatically swung to the locked position shown in FIG. 15. Also provided in the members 18 are lock pin openings 29 and the members 25 also have lock pin openings 30, which, when the locks 25 are pivoted to locked position as shown in FIG. 15, align so that lock pins 31 can pass through the openings 29 and 30. The pins 31 may be cotter pins or other suitable pins which will hold the members 25 in the locked position shown in FIG. 15. Also provided in the lock members 25 are upper openings 32 for reception of a suitable unlocking pull cord, such as shown at 33. The lock components shown in FIGS. 15 and 16 may be referenced as a locking device.

Each of the connector assemblies 12 is identically constructed. It is to be understood that forwardly extending lock parts 18*a* and lock plates 25 are also provided on the front end of the platform 10 so that the dock section 11*a* immediately adjacent to it may be releasably locked to it in the manner disclosed.

Figure 1A:
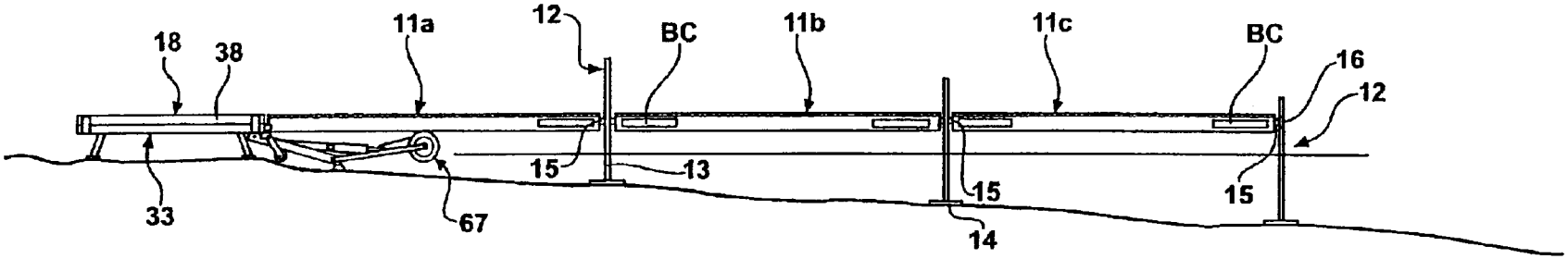
FIG. 1A is a schematic, side elevational view thereof on a reduced scale.
Figure 3A:
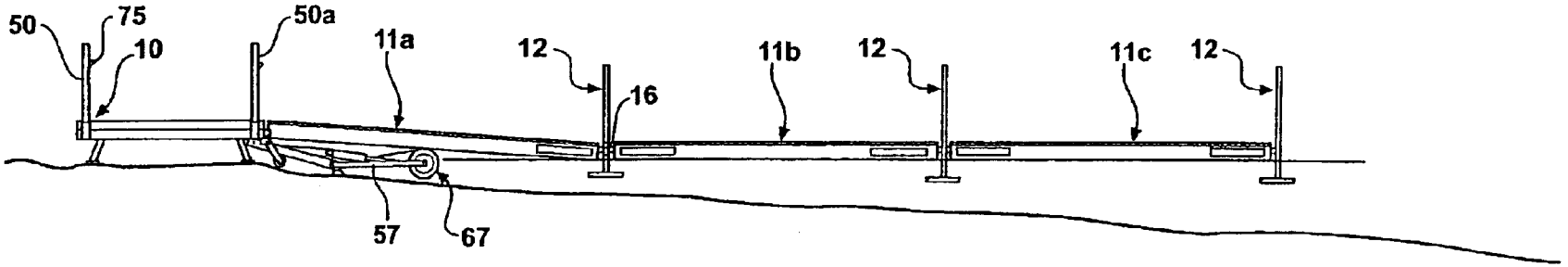
FIG. 3A is a schematic, side elevational, reduced size view similar to FIG. 1A showing the dock supporting poles as released and the dock sections floating on the water.

Referring now to FIG. 1A, it is to be understood that the position of the connector cross rails 15 is such that the installed dock sections can be supported about 16 inches above the water level in inland lake and river installations as shown in FIG. 1A. While only three sections 11 are illustrated in FIG. 1 for purposes of convenience, it is to be understood that normally six such 10 foot sections 11 are utilized so the dock extends appreciably out above the water and provides room for the docking of boats on both sides of the installed dock.

Figure 2:
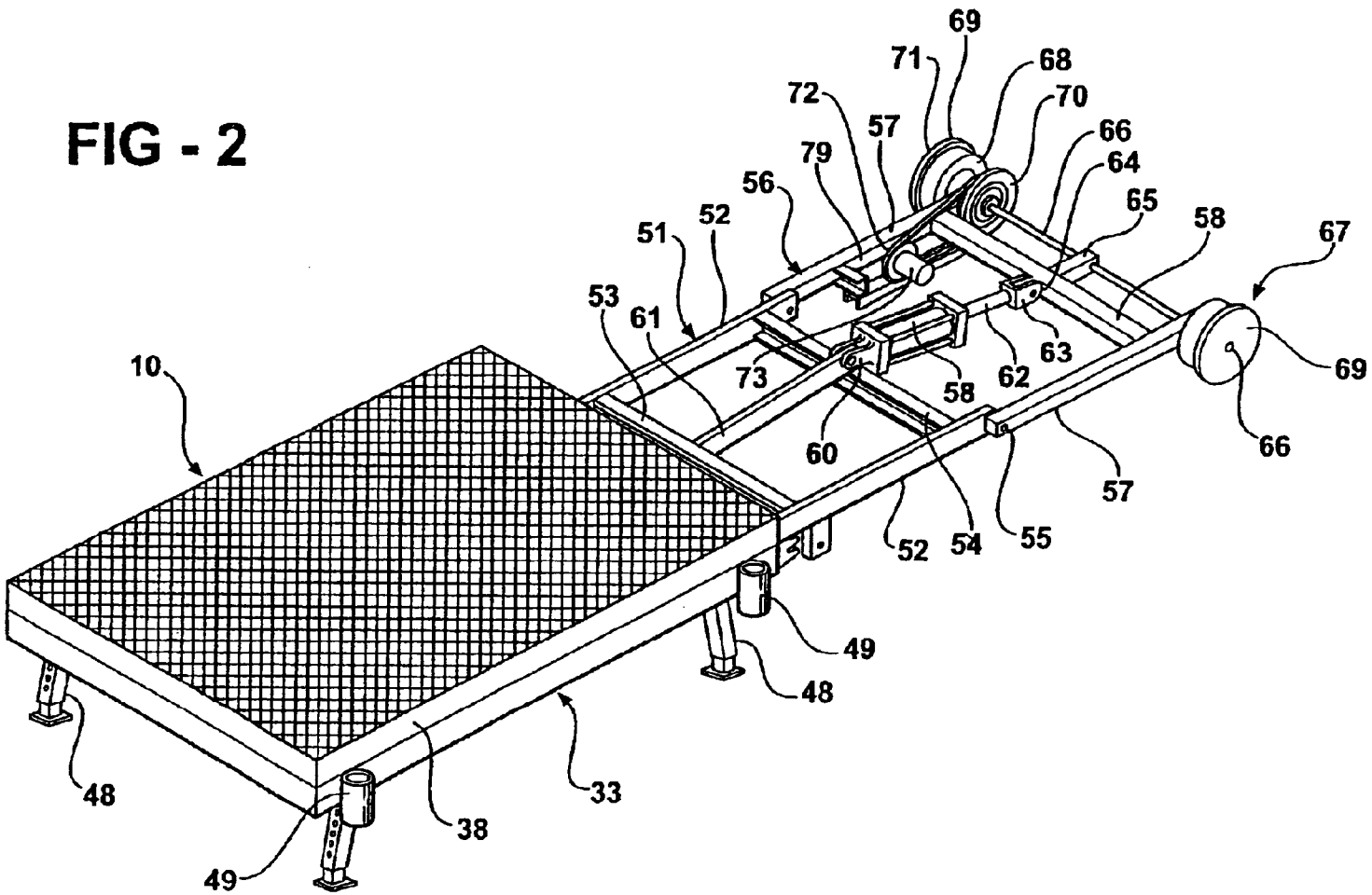
FIG. 2 is a schematic, enlarged, perspective plan view illustrating the loading-unloading platform and attendant drive device.
Figure 3:
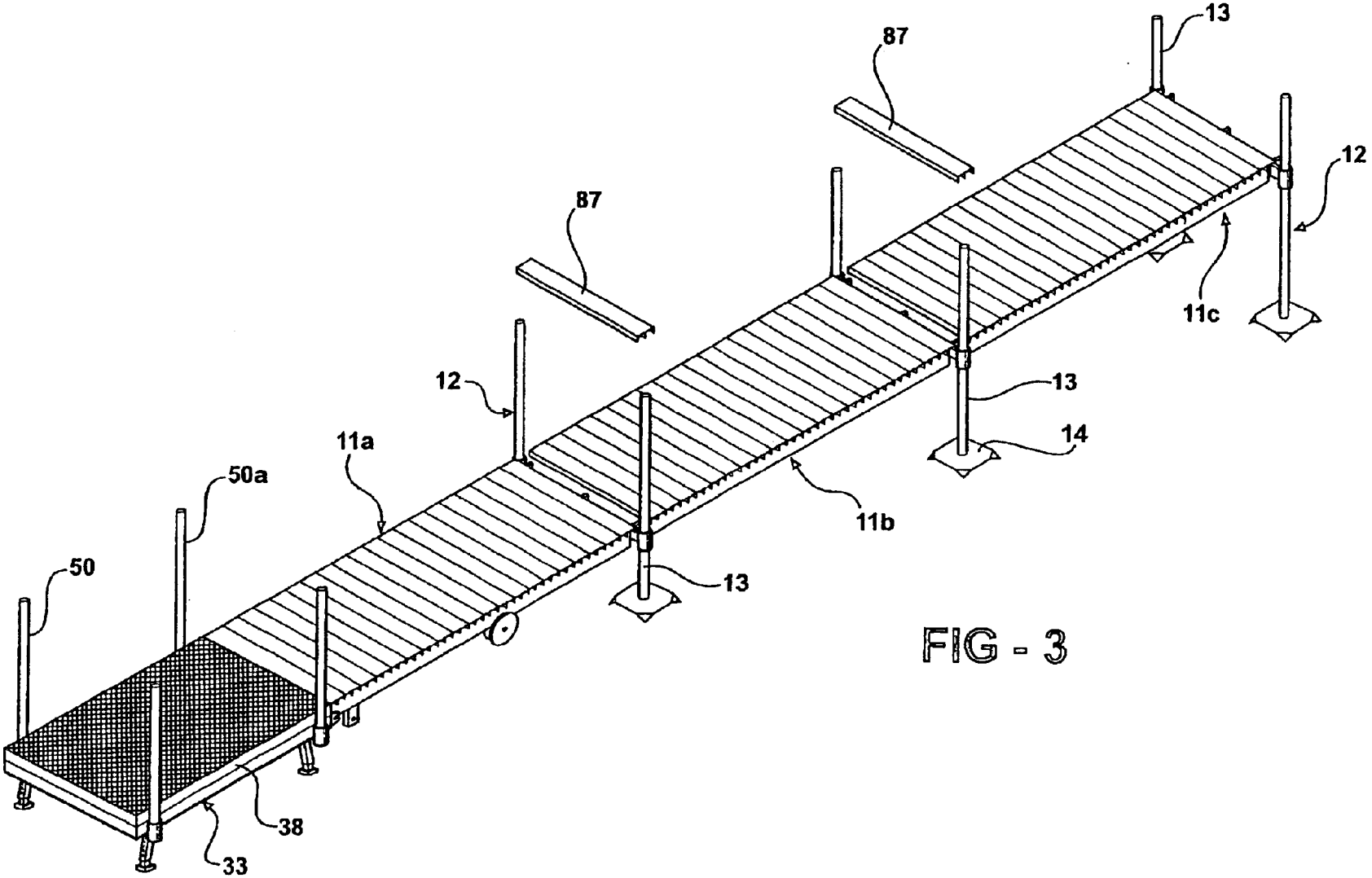
FIG. 3 is a schematic view similar to FIG. 1 illustrating initial steps in the automated retrieval of the dock system.
Figure 8:
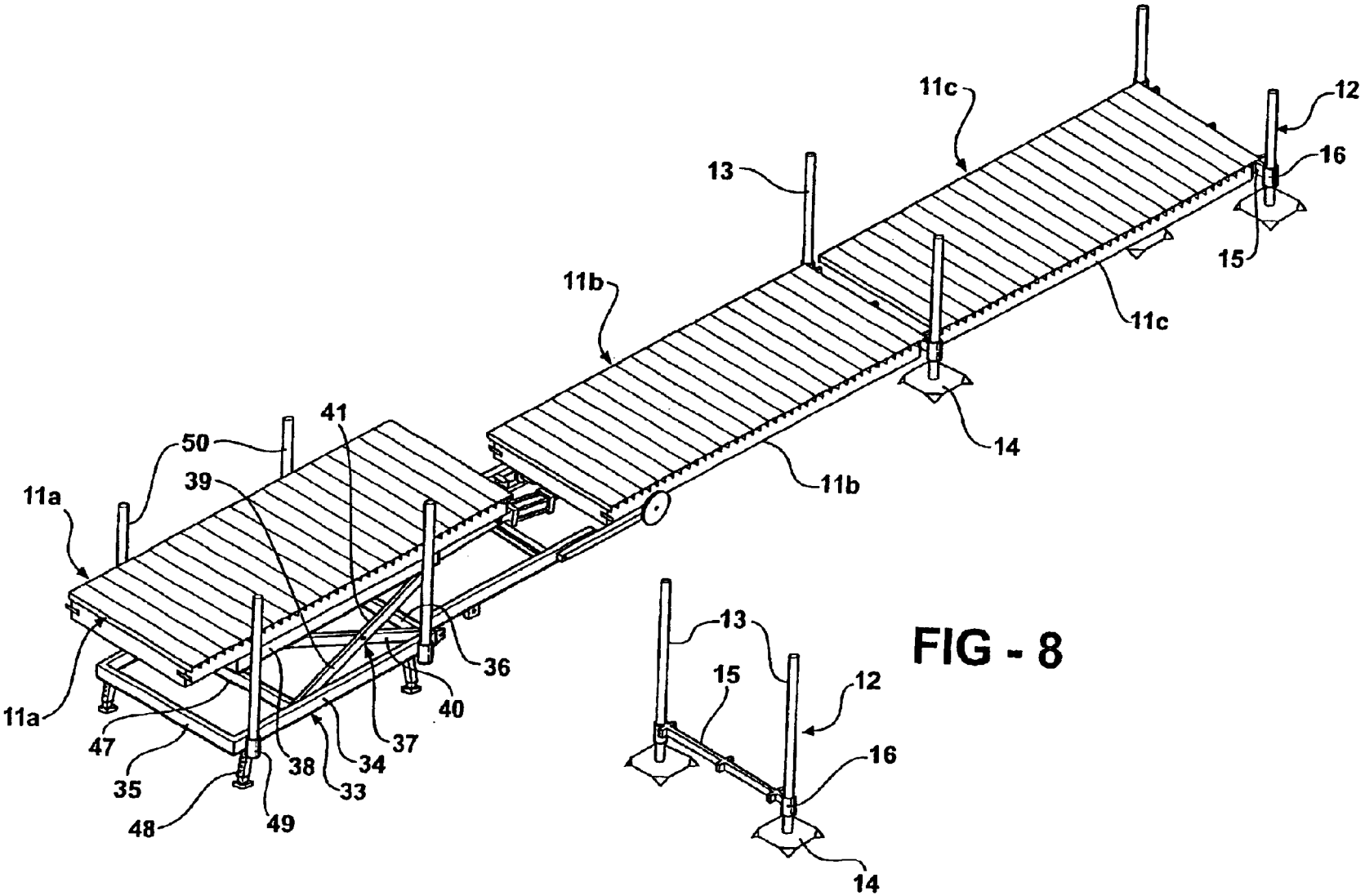
FIG. 8 is a schematic view similar to FIG. 7 showing the removed dock section as having been raised upon the dock lift table.
Figure 8A:
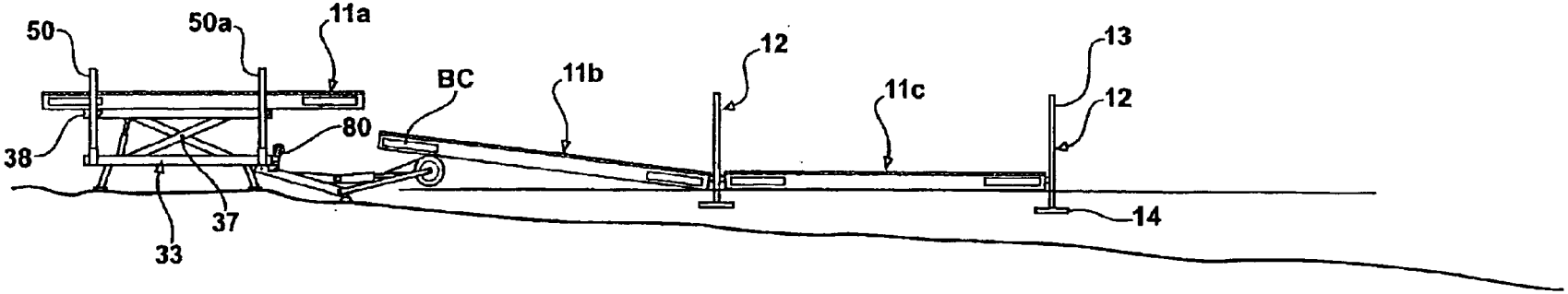
FIG. 8A is a schematic side elevational view thereof on a reduced scale.
Figure 10A:
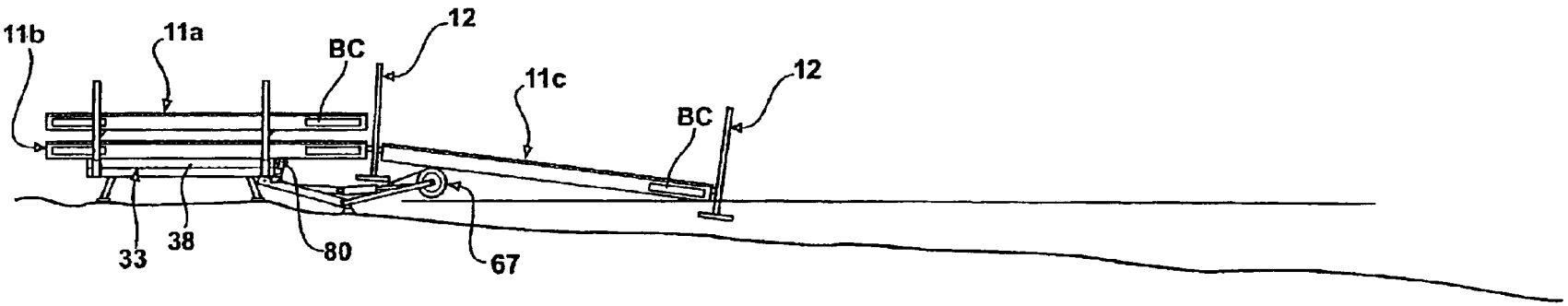
FIG. 10A is a schematic side elevational view thereof on a reduced scale.

FIGS. 2 and 8 particularly illustrate a shore supported device comprising a shore base 10 which can be employed. The base 10 may comprise a base frame, generally designated 33, which includes side rails 34 and front and rear cross rails 35 and 36. A scissors linkage, generally designated 37, which will be more particularly described, supports a lift platform or table 38 for raising and lowering movement from the position shown in FIG. 2 to the position shown in FIG. 8, for example. The scissors linkage 37 at each side of the storage platform 10 includes a pair of links or legs 39 and 40, which are pivotally connected at 41. The front ends of members 39 and 40 are pivotally connected to the side rails 34 and the lift platform 38, respectively, as at 34*a* and 38*a* and the rear ends of the members 39 and 40 are permitted to slide forwardly and rearwardly as required with respect to the frame members 34 and the platform 38. For this purpose, synthetic plastic VHMW slide shoes 42 (see FIG. 23) are pivotally provided as at 42*a* on the rear ends of the members 39 and 40 which reciprocate in the tracks 43 and 44, provided internally on the upright channel members 34 and 38.

A pair of hydraulic cylinders 45 and 46, pivotally connected at their rear ends to a cross beam 47 spanning the legs 39, have their piston rods 45*a* pivotally connected to the underside of the lift platform 38. Because the rear ends of members 39 and 40 can slide the cylinders 45 and 46 can achieve a more vertical position and enhance their lift capability. The storage platform frame 33 can be mounted on vertically adjustable legs 48. It will be noted that sockets 49 are provided at the four corners of the platform 33 to receive upright posts 50 and 50*a*, as shown in FIG. 8, which form an open enclosure for the dock sections when they are stacked in position. Further, enlarged diameter wheels (not shown) and a suitable tow bar (not shown) may be mounted on the frame 33 so that once the dock sections have been stacked on the storage platform 10, the entire platform 10 may be moved to an alternative dock storage location, such as the interior of a building. Also, alternatively but not preferentially, the platform 10 may not incorporate a lift table 38 and deck section stacking on the ground may be manually accomplished as the dock sections are brought in and removed from the unit 10.

Secured to the base frame front member 36 is a module transport device or drive assembly which includes a forwardly extending front frame section, generally designated 51, fixed to the assembly 33. The assembly 51 includes forwardly projecting side members 52 (FIG. 2) and cross members 53 and 54. Pivotally connected to the front end of the projecting frame 51, as with pivot pins 55, is a vertically pivotal frame, generally designated 56, comprising side members 57 joined by a cross member 58. Mechanism operating to raise and lower the drive assembly may comprise a double acting hydraulic cylinder 59, pivotally supported as at 60 on a forwardly and upwardly inclined central beam 61 fixed on frame 51. Cylinder 59 has a piston rod 62 with a clevis 63, which is pivotally connected as at 64, to the front end of frame 56. Cylinder 59 is capable of raising the frame 56 about pivots 55 to a limited degree and returning it.

Rototably supported in bearings (not shown) provided on arms 57 and a central support arm 65 is a drive shaft 66 which, at each of its ends, is fixed to a drive element or drive wheel, generally designated 67, comprising a tire 68 bounded by an outboard guide disc 69. The tires are inflatable but are maintained soft to provide the desired traction. The purpose of the knobby treaded tires 68 is to move the dock sections 11*a*, 11*b*, or 11*c* forwardly or rearwardly within the lateral confines of the guide members 69 of greater diameter which are laterally inboard of posts 50. A sheave or other drive 70 is fixed on the shaft 66 and connected via a belt 71 to a sheave 72 on the drive shaft of a reversible drive which may comprise a hydraulic motor 73 fixed on a motor mount member 74 mounted on frame 56.

To assist in the stacking of the dock sections in an overhead stack, projecting hook members 75 are provided on the rear post 50 and like forwardly projecting hook parts 75 are provided on the front posts 50*a*. The hook parts 75 are provided to releasably receive dock module support rods 76 (see FIG. 23) at the front and rear of raisable platform 38, which are laterally outboard of the vertical path of travel of the lift platform 38.

When a deck section 11*a*, 11*b* or 11*c* is to be loaded to the lift platform 38, the cylinder 59 is operated to raise or tilt the platform 56 upwardly slightly and this pivotal movement of one dock section relative to another is permitted by the nature of the lock devices L, and the cylindrical pins 20, which form a part thereof. To facilitate a smooth passage of the dock section, across the lowered lift platform 38, idler rollers 78 (FIG. 17) are rotatably mounted on pins 79 mounted on swingable arms 80, which are mounted to pivot on laterally, outwardly projecting pins 81 at each side of the platform 10. The arms 80 may be referenced as a lift device. Once the dock section being loaded is uncoupled, as shown in FIGS. 18 and 19, the arms 80 can be pivoted upwardly to a position in which the lock projections 81*a* provided on arms 80 are received within the locking device L locking recesses 23 provided on plates 18*a* fixed on the front end of storage platform 10. The associated locking members 25 will be automatically pivoted downwardly to locking position to hold the arms 79 in the vertical position. The rollers 78 project sufficiently upwardly path above the lift frame or platform 38 when the latter is in the down position to facilitate the passage of a deck section to a position on the lift table 38.

As will later be described, when the dock is being installed, the dock sections 11*a*, 11*b*, and 11*c* will be floating on the water and must be raised on the connector assemblies to a given position above the water level. Each section is provided with enough buoyancy by way of hollow air filled closed drums or cylinders BC under each end of the dock sections and secured thereto (see FIGS. 1A through 10A and FIG. 23) to support the weight of several persons while floating. For this purpose, to accomplish this dock module by dock module without the necessity of entering the water, the connector assemblies can be releasably provided with a winch, generally designated W and shown in FIGS. 24 and 25, which may comprise a crank-operated reel 82 on which a lifting strap 83 is mounted, which has a hook 84 on the lower end thereof. The winch W can be secured to a cross frame 85 which is releasably secured to span the tops of posts 13. The frame can have sockets 85*a* for receiving the upper ends of the posts 13 which carry disengageable mechanism which may comprise set bolts 86*a*. The hook member 83 is designed to hook under the cross rail 15 provided on each of the connectors and raise the cross rail 15 upwardly on the posts 13 to a position in which they can be fastened in position by suitable set bolts 17.

The pivoting action of one dock section with respect to another, and with respect to platform 10, is permitted by the locking system employed in FIGS. 15 and 16 wherein a pivot of lock rod members 20 is permitted with respect to the sockets 23. The winch W can be secured in position to lift the cross rail 15 on successive connector assemblies from the outermost dock module inwardly in the indicated manner.

Figure 4:
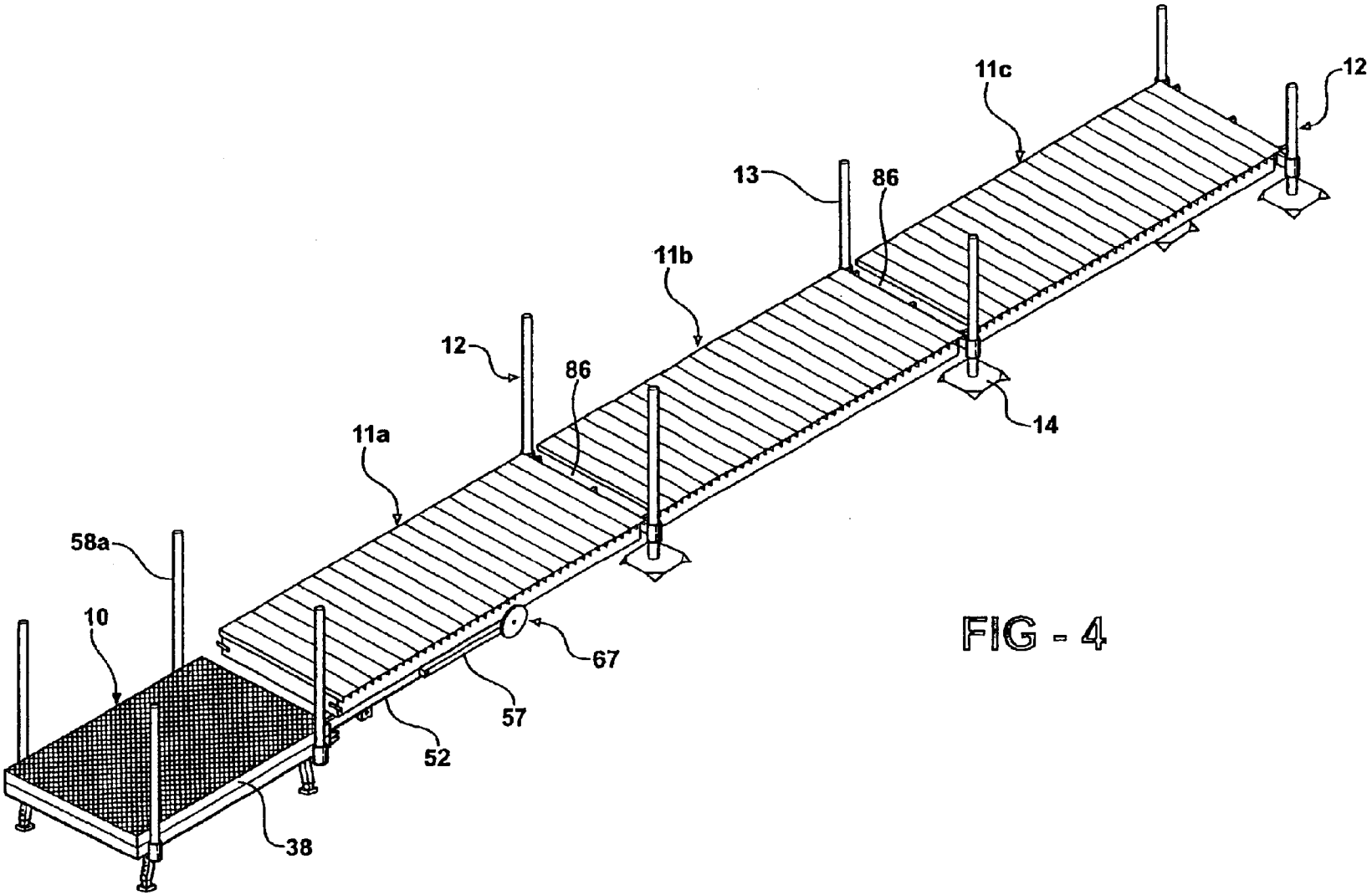
FIG. 4 is a schematic view similar to FIG. 3 showing the dock floating as in FIG. 3A.
Figure 4A:
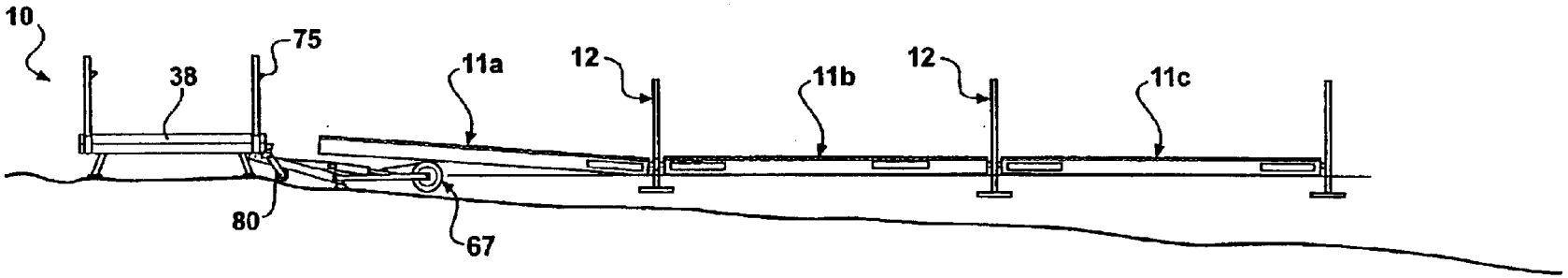
FIG. 4A is a schematic, reduced size side elevational view similar to FIG. 4 with the dock section adjacent the loading and unloading platform unit having been unlocked and then backed away to permit the load assist arms to swing up and lock to the frame of the platform unit.
Figure 4B:
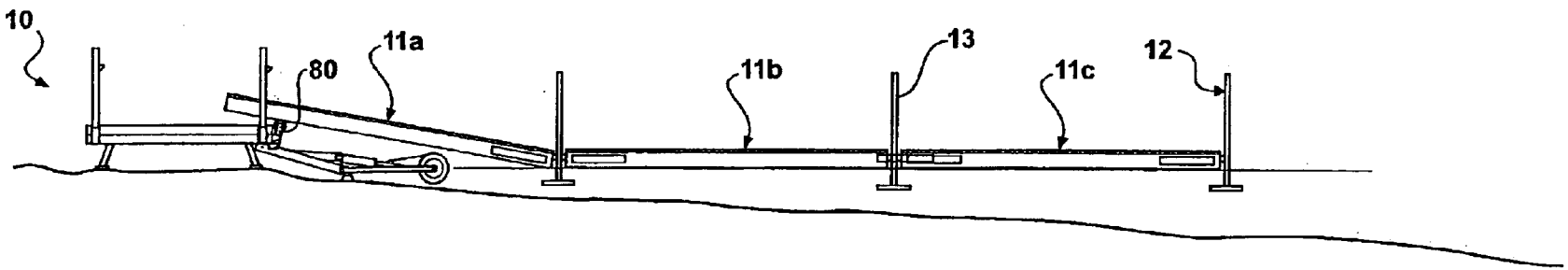
FIG. 4B is a similar schematic, reduced size side elevational view showing the train of dock units as having been moved rearwardly or inwardly to a position in which the dock section adjacent the loading and unloading platform is about to be loaded to the platform.
Figure 21:
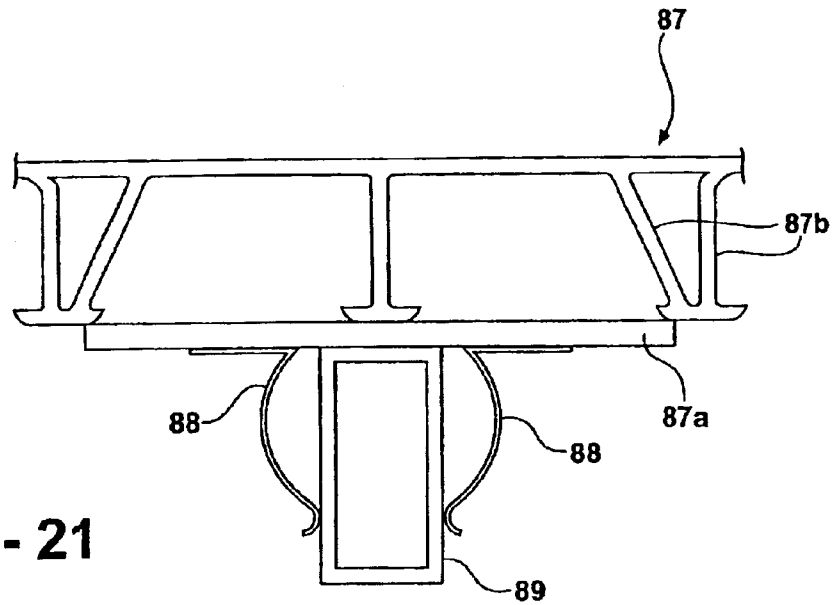

It will be noted that spaces 86 are provided above connector rails 15 between the dock members 11*a*, 11*b*, and 11*c*, as indicated in FIG. 4. These spaces 86 are filled by cover members, generally designated 87 (FIG. 21), which have bottom plates 87*a* with dependent spring legs 88, which can descend down to an embracing position with the members 89 provided on the cross rails 15 of each connector 12. The commercially available dock sections 11*a*, 11*b*, and 11*c* may be constructed as shown in FIG. 23 of an extruded vinyl top T with ribs 87*b* of the character employed in cover 87 snapped on side beams 87*c*.

FIG. 22 is a schematic electro-hydraulic diagram which illustrates various conventional parts. The valves indicated at V-1, V-2, and V-3 are conventional Vickers hydraulic valves which operate the cylinders 45, 46 and 59 and the hydraulic motor 73. The schematic electrical circuit for operating the valves is shown in FIG. 22A and each valve V-1 and V-3 is shown as having an advancing solenoid 89 and a retracting solenoid 90 energized by switches 91 and 92, respectively. Valve V-2, which operates motor 73, has a solenoid 93 operated by a motor 73 in one direction and a solenoid 95 operated by a switch 96 for driving it reversely. All switches may be push button activated.

THE OPERATION

When it is desired to remove the dock to the storage platform 38, the first step is to remove the connection cover members 87 and install the posts 50 and 50*a* in position in the sockets 49. The set bolts securing the connector cross rails 15, in raised position, are then sequentially backed off, starting with the outermost dock section 11*c* and proceeding inwardly or rearwardly. This permits each dock section to initially pivot downwardly with respect to the immediately rearward dock section to which it remains joined until the dock sections all float in position, as illustrated in FIG. 4.

The next step is to raise lift frame 57 via cylinder 59, unlock the locking members 25 securing the dock section 11*a* to the storage module frame 33, and operate drive members 67 to move the entire dock forwardly or outwardly sufficiently to clear the jaws of the stationary lock members 18*a* on platform 10 utilizing reversible drive motor 73. At this point, arms 80 can be manually swung up to a locked position to dispose the rollers 78 in operative position. Arms 80 are locked in place in the lock sockets 23 on platform 10.

Figure 5:
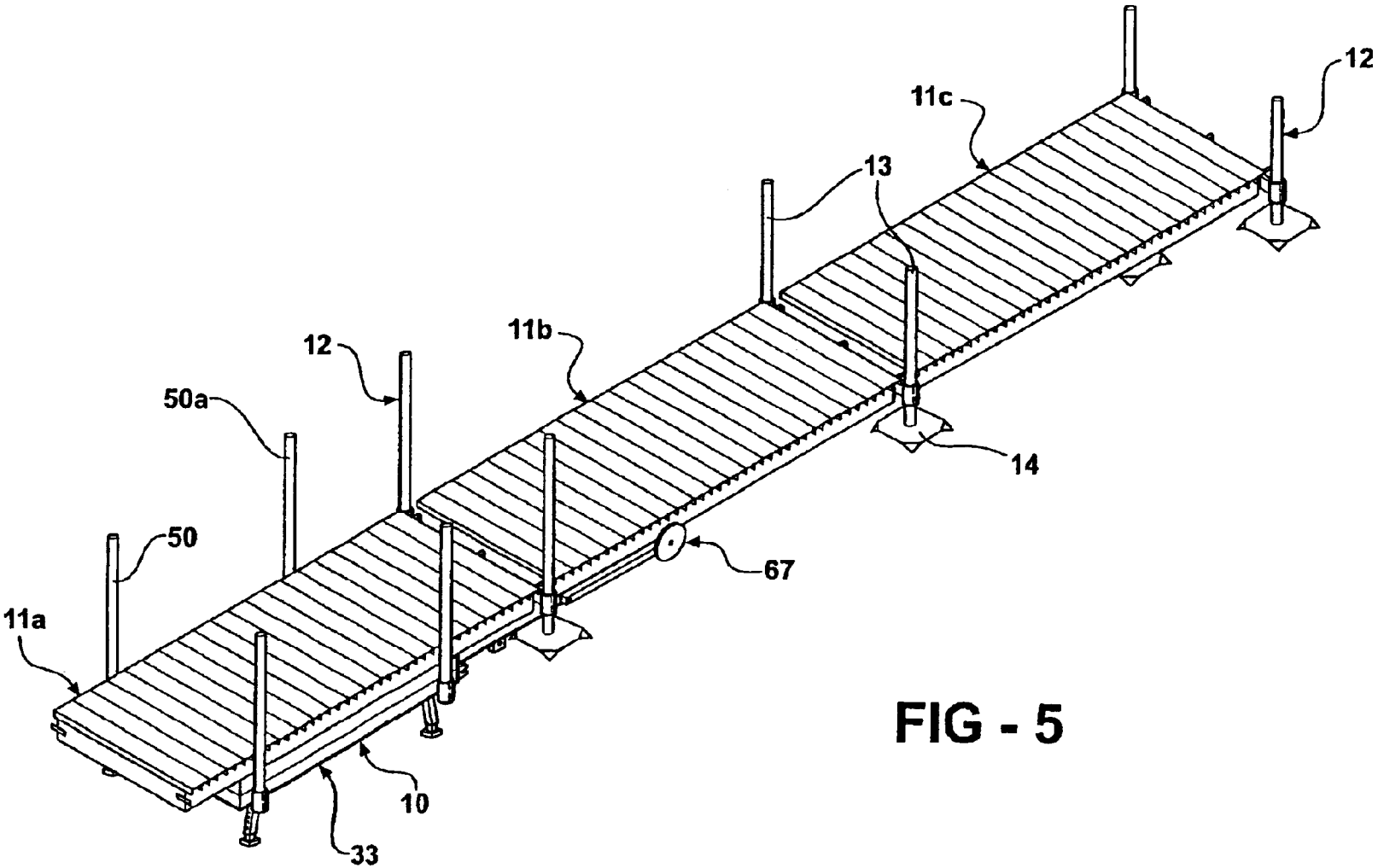
FIG. 5 is a schematic view similar to FIG. 4 in which the loading of the adjacent dock section to the loading platform has been accomplished.
Figure 5A:
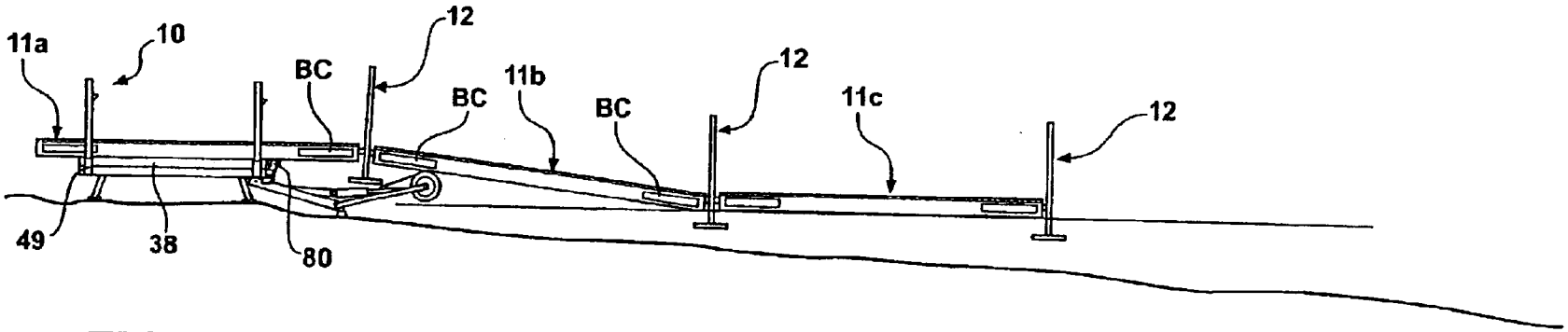
FIG. 5A is a schematic side elevational view showing the elements in the disposition of FIG. 5 on a reduced scale.
Figure 7A:
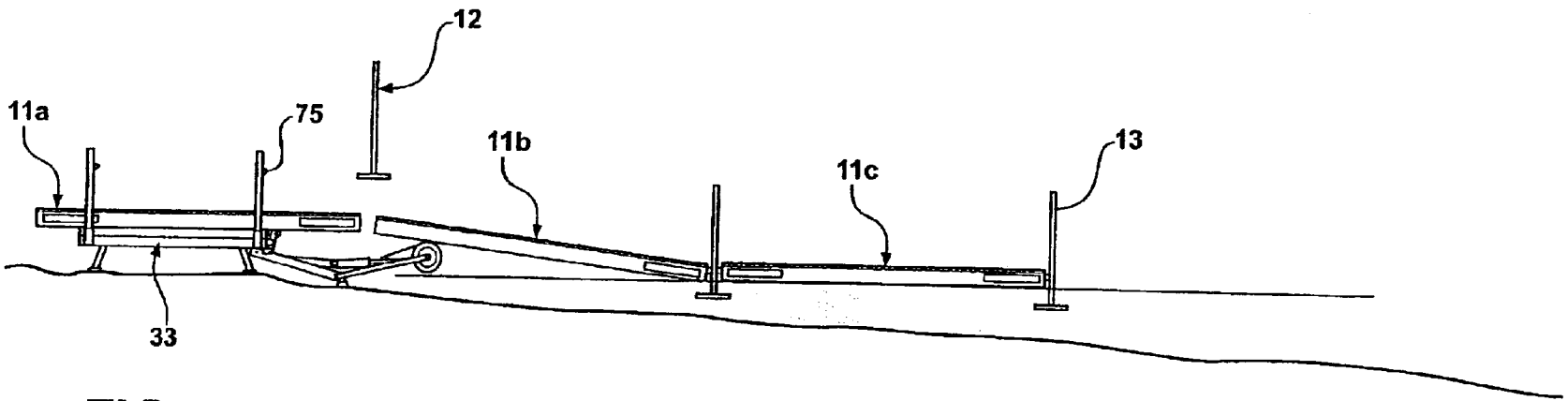
FIG. 7A is a schematic side elevational view thereof on a reduced scale.
Figure 6:
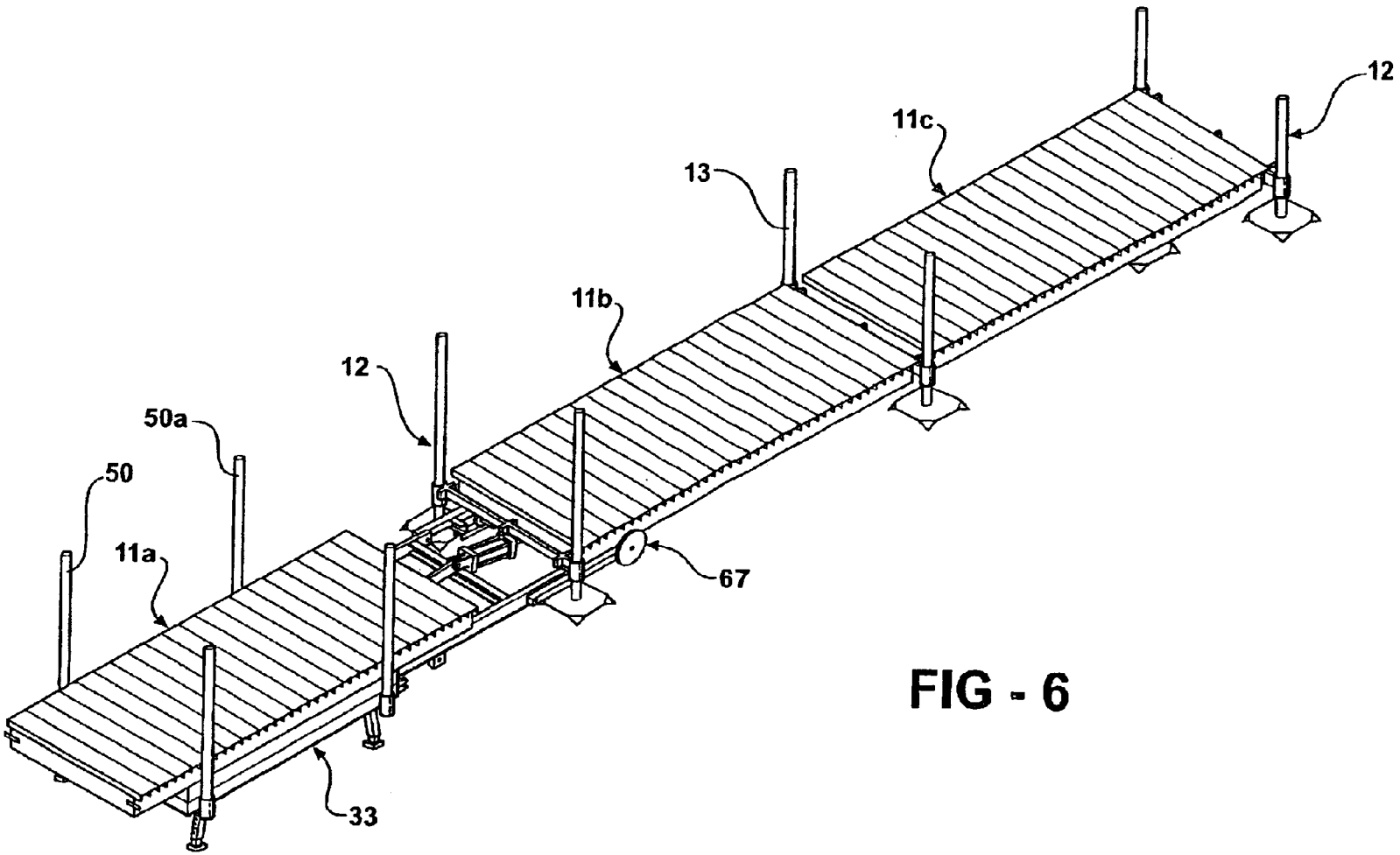
FIG. 6 is a schematic view similar to FIG. 5 in which the remaining dock sections have been released and backed out.

Again, because of the nature of the locks shown in FIGS. 15 and 16, pivoting movement of the dock section 11*a*, with respect to the dock section 11*b*, is accomplished without binding. At this point, the motor 73 can be operated to revolve the drive assembly 67 in a direction to move the dock section 11*a* rearwardly or inwardly across rollers 78 until it rests on the platform 38 within the confines of the poles 50 and 50*a* as shown in FIG. 5. In moving rearwardly onto table 38, the dock section 11*a*, of course, brings the entire train of dock modules rearwardly until the lock members 25 connecting the front end of the deck section 11*b* are accessible from the adjacent lift platform 38 through the openings 86. With the locks 25 manipulated to unlock the dock section 11*a* from the dock section 11*b*, the motor 73 is operated to move the section 11*b* and its joined section 11*c* forwardly or outwardly to provide a clearance as shown in FIG. 6. Then, the connector assembly 12 connecting dock sections 11*a* and 11*b* may be removed from between the dock sections 11*a* and 11*b*.

Storage platform 38 may then be raised by the cylinders 45 and 46 to a level (FIG. 8) to dispose the bottom of the dock section 11*a* above the level of the hooks 75 on poles 50 and 50*a*. Platform spanning support rods 76 can then be placed in position under the deck section 11*a* and the lift platform 38 lowered to leave the deck section 11*a* supported on the posts 50 and 50*a* via rods 76.

Figure 9:
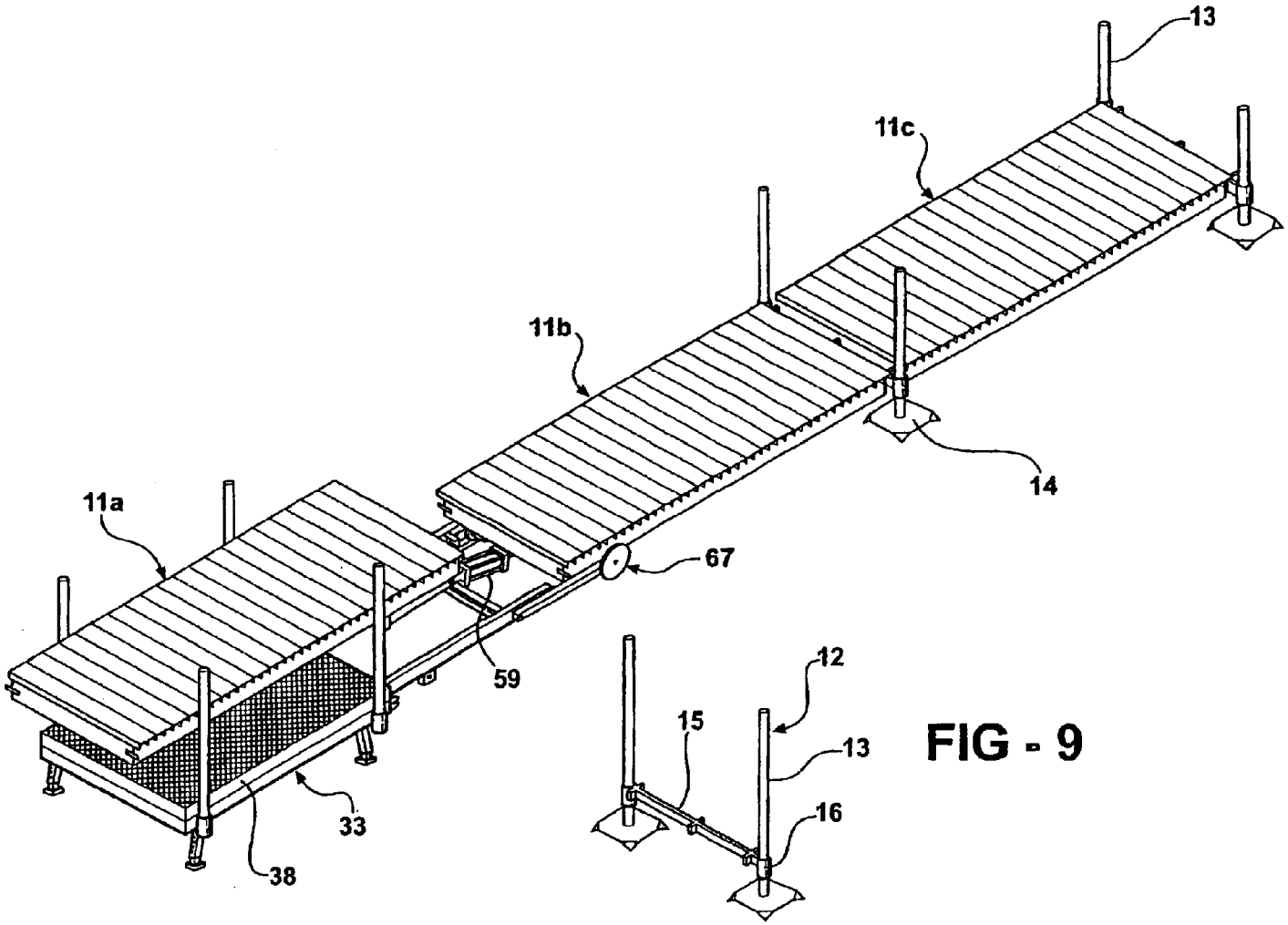
FIG. 9 is a schematic view similar to FIG. 8 showing the removed dock section as supported on the posts of the loading and unloading platform posts while the lift table is lowered to original position.
Figure 10:
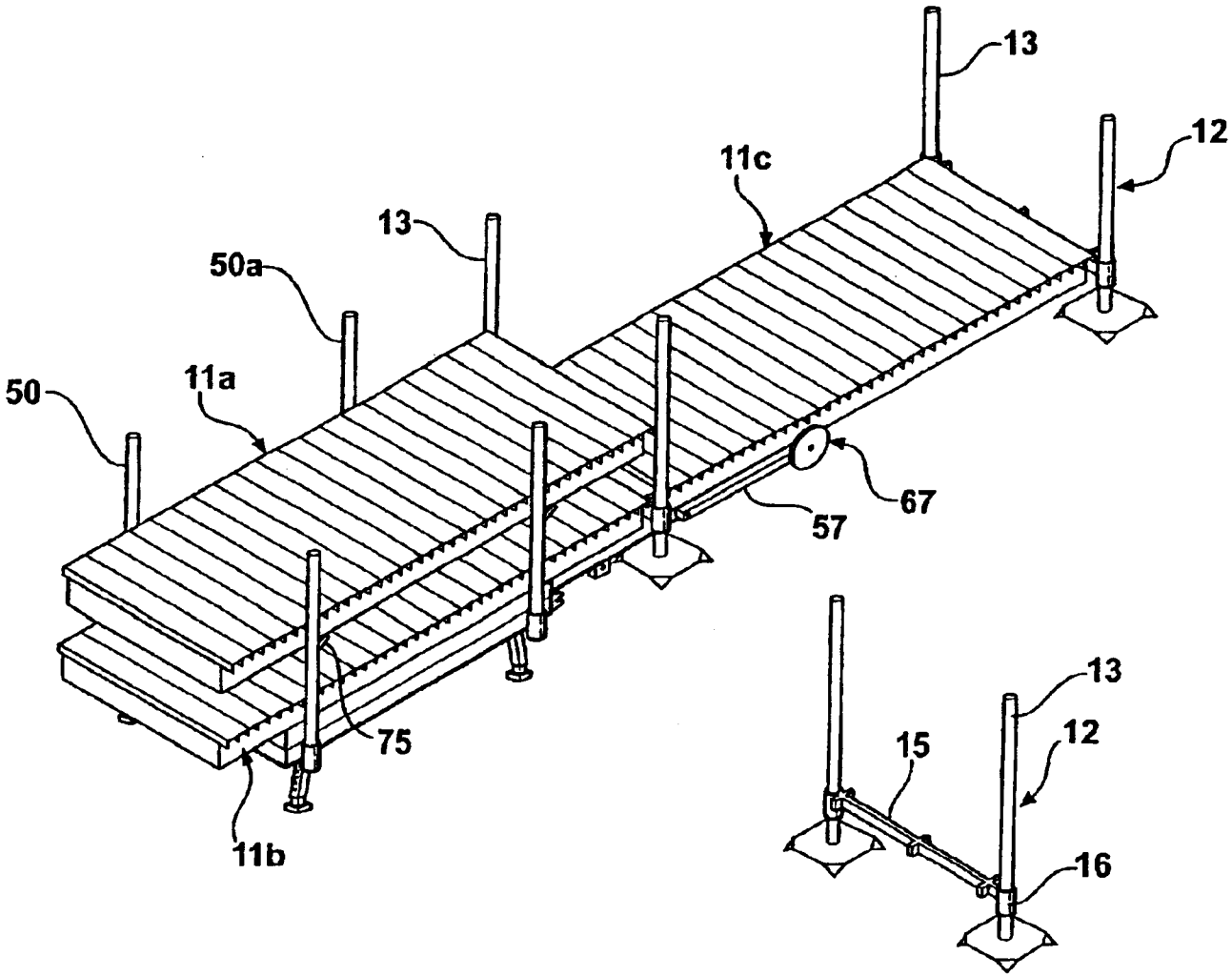
FIG. 10 is a schematic view similar to FIG. 9 showing the middle dock section as having been loaded to the loading and unloading platform table beneath the first dock section removed.
Figure 11:
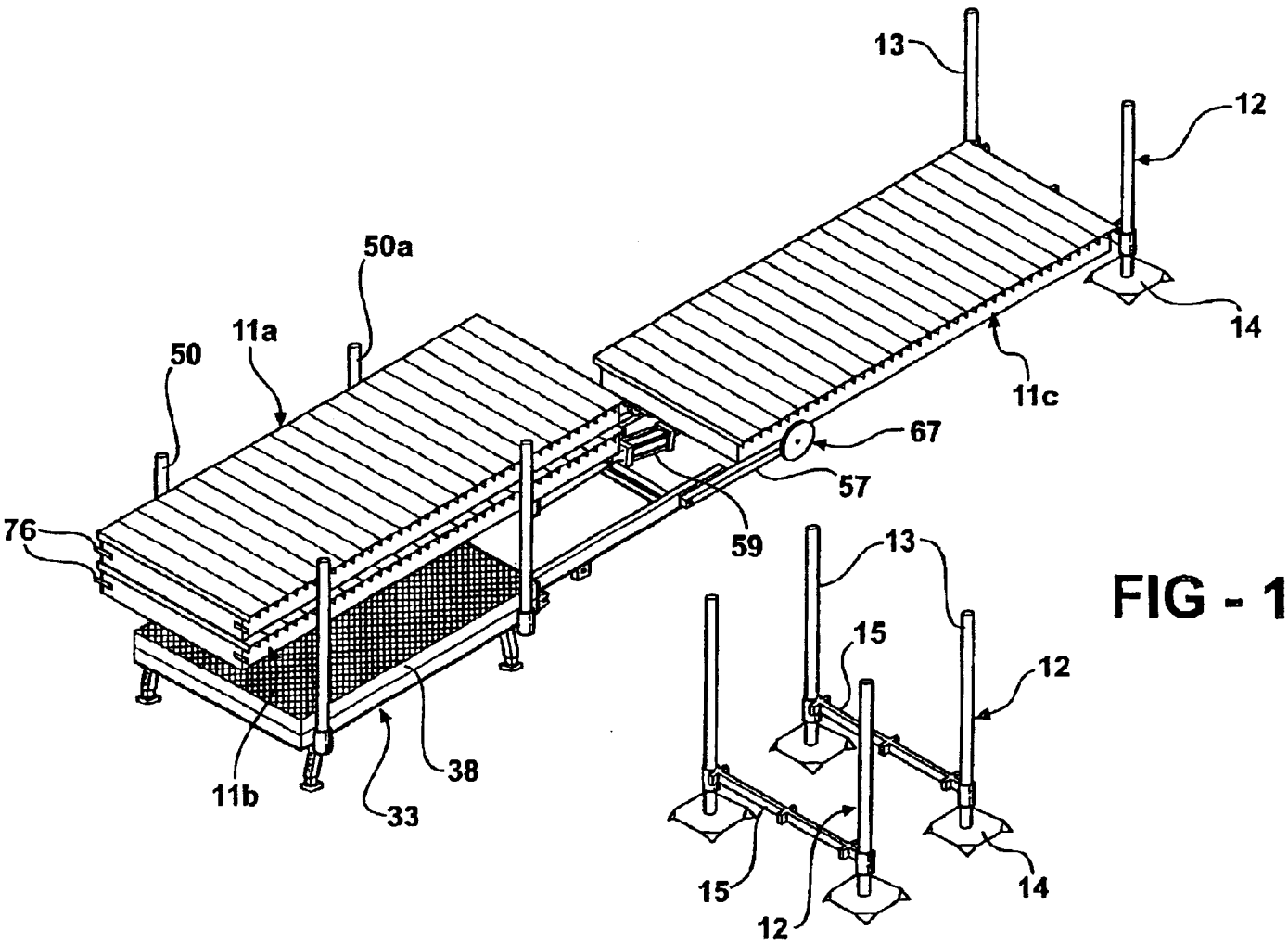
FIG. 11 is a schematic view similar to FIG. 10 but showing the intermediate dock section as having been raised to a supported position on the loading and unloading platform posts and the lift table as having been returned to original position.

FIG. 9 shows the apparatus in position for arrival of the next deck section 11*b*, with the lift table 38 having been moved to lowered position to receive it. The rear end of tilted dock section 11*b* and the dock section 11*c* are floating on the lake body. Motor 73 is then operated in a direction to move the dock section 11*b* across rollers 78 inwardly to a position beneath the dock section 11*a*. Dock section 11*b* is then unlocked from the connector 12 adjacent the rear end of dock section 11*c*, which has traveled rearwardly with it, in the manner previously disclosed. Once dock section 11*c* is backed off and the dock module 11*c* unlocked, the connector assembly 12 between the dock sections 11*b* and 11*c* can be removed for storage. With dock module 11*c* positioned above drive units 67, the lift table 38 may then be raised by cylinders 45 and 46 to move the dock section 11*b* to a position in which its lowermost surface is above the level of the hook projections 75. Prior to lifting table 38, a pair of crosswisely disposed two-by-fours or the like are laid across the deck section 11*b* at either end. When the lift table 38 is raised, these two-by-fours or the like ensure a separation between the dock members 11*a*and 11*b*. The table 38 is raised sufficiently to move the uppermost deck section 10*a* off the rods 76, which are removed once the deck section 10*a* clears them. It is when the deck section 11*b* is raised sufficiently that the rods 76 may be reinstalled beneath section 11*b* that the table 38 is lowered to deposit deck section 11*b* on the rods 76. Thence the drive assemblies 67 are operated to move the dock section 11*c*in under the deck section 11*b* to a position resting on the lowered lift table 38. Finally, the lock members 25 at the outer end of dock section 11*c* are manipulated to permit the foremost connector assembly 12 to simply be moved outwardly to clear the fixed locking jaws 18*a* and be removed for storage.

For docks which extend beyond three dock sections, the procedures indicated are performed until all dock sections are stored. To replace the dock in the spring, it is merely necessary to repeat the steps in reverse. The first step is to restore the connector assembly 12 to the front of the dock section 11*c* and lock it in position. The connector assembly rail 15 will, of course, be loosely disposed on the poles 13. Dock section 11*c* is then pushed manually off the platform 38 until it can be engaged by drive units 67 which are raised to engage it.

With dock section 11*c*resting on drive units 67, the table 38 can be raised to move dock sections 11*b* and 11*a*upwardly and the rods supporting section 11*b* on the poles 50 and 50*a* can be removed. The table 38 can be then lowered to dispose the section 11*a* just above hooks 75 to permit rods 76 to be restored to support dock section 11*a*. Then table 38 is fully lowered and connected to a connector unit 12 which has been previously connected to the rear end of dock section 11*c*. The connector rail 15 on this connector is loosely disposed on support poles 13 at this time. With dock section 11*b* so connected to dock section 11*c*, the drives 67 are operated to move dock sections 11*b* and 11*c* as a train outwardly. With deck section 11*b* adjacent platform 10 in tilted position and deck section 11*c* floating, a connector 12 can be locked to the rear end of dock section 11*b*. Then lift table 38 can be raised to move deck section 11*a* off the rods 76 and the rods 76 removed. Next, lift table 38 is lowered and dock module 11*a* is lowered to a position in which it can be releasably locked to the connector 12 which is loosely supporting its legs 13. Then drives 67 are operated to move dock section 11*b* outwardly to a position in which drives 67 can engage under dock section 11*a*. Finally, the rear end of dock section 11*a* is releasably locked to the platform 10 and drive lift frame 57 is lowered to permit deck unit 11*a* to at least partially float.

Then, beginning with the outermost dock section 11*c*, the winch W is releasably installed in the manner discussed to sequentially raise both ends of dock sections 11*c*, 11*b*, and 11*a*in that order. After raising the outer end of dock section 11*c*, the winch W is demounted from the connector poles 13 at the front end of dock section 11*c* and moved to the connector poles 13 at the rear end of dock section 11*c*. The winch W is thus moved sequentially to raise both ends of dock sections 11*b* and 11*a*.

The disclosed embodiments are representative of presently preferred forms of the invention, but are intended to be illustrative rather than definitive thereof. The invention is defined in the claims.

We claim:

1. In a dock module installation and removal system:

a. a shore supported device for sequentially moving dock modules disposed in disengageable train formation to and from shore including locking devices for disengageably receiving and releasably locking the rear end of the dock module adjacent to said device to permit some vertical swinging movement of the rear end of the dock module;

b. said device including a forwardly projecting drive assembly having a drive element for engaging said adjacent dock module;

c. mechanism mounting said drive assembly for vertical movement from a removed position in which said drive element is out of engagement with a dock module into driving engagement therewith; and d. a drive for driving said drive element to transport said adjacent module when said locking devices are not engaged.

2. The device of claim 1 wherein said device includes a platform and said drive assembly incorporates a frame pivotally carried by said device, said frame carrying at least one revolvable drive wheel as said drive element, and said drive comprising a reversible motor.

3. The device of claim 2 wherein said dock modules have an undersurface and sides, and said drive element comprises pair of drive wheels with tires for engaging said undersurface of a module and laterally outward guides for guiding said sides of a dock module as it is transported.

4. The device of claim 2 wherein a lift device for raising a module is mounted rearwardly of said drive wheel for vertical movement from an inoperative lower position to a position raising the module sufficiently that it can be fed across said platform by said drive wheel.

5. The device of claim 1 wherein said device has a platform and module supports adjacent said platform with supporting elements for supporting a plurality of modules in vertically stacked position above said platform; and power operated scissors linkage mechanism is provided for raising said platform from a module receiving position to a raised position in which a module can be added to the bottom of said stack and for supporting said module while said supporting elements are positioned to support it before returning to said receiving position.

6. A dock system for lakes and other bodies of water comprising:

a. a shore base carrying a disengageable locking element for receiving and retaining a dock on a front end thereof;

b. a train of floatable dock module components releasably connected to said locking element and forming a walkway extending forwardly from said base;

c. said dock module components comprising modules with connector assemblies at the ends of said modules; and disengageable locking elements on said connector assemblies and said modules to retain said modules coupled in train disposition;

d. laterally spaced posts, with lake bed engaging dock supporting base parts, on which said module components are vertically slidably received to be movable from a lower position in which said modules float to a raised position in which said modules are safely above the water; and disengagable mechanism for retaining said module components in raised position; and e. a module transport device connected with said shore base and operable to move said modules sequentially forwardly to form a train as said modules are sequentially locked together or to move said modules sequentially rearwardly to detrain them and remove them to shore as said modules are sequentially unlocked.

7. The system of claim 6 wherein said locking elements on said modules and connector assemblies are automatically lockably engaged when said modules come into operative engagement with their respective connector assemblies and are manually disengaged therefrom.

8. The system of claim 6 wherein said transport device comprises a drive assembly projecting forwardly from said base, said assembly including a frame pivotally supported by said shore base to swing in a vertical path and having a drive element at its forward end for engagement with an unlocked dock module for moving said unlocked module forwardly or rearwardly.

9. The device of claim 8 wherein said dock modules have an undersurface and sides, and said drive element comprises a pair of drive wheels with tires for engaging said undersurface of a module and laterally outward guides for guiding said sides of a dock module as it is transported.

10. The device of claim 9 wherein a lift device for raising the portion of a module adjacent said base is mounted for vertical movement rearwardly of said drive wheels from an inoperative lower position to a position raising said portion of a module sufficiently that it can be fed across said base by said drive wheels.

11. The device of claim 6 wherein said base has a platform normally disposed in a module receiving position and module supports adjacent said platform have elements for supporting a plurality of modules in vertically stacked position above said platform; and power operated linkage mechanism is provided for raising said platform from a module receiving position to a raised position in which a module can be added to the bottom of said stack before returning said platform to said receiving position.

12. The system of claim 11 wherein said locking elements on said modules comprise laterally projecting rods and said connector assemblies include frame elements having front and rear locking elements comprising receiving jaws with rod receiving sockets and pivotal latches with rod trapping arms having camming surfaces thereon pivotally mounted to be pivoted from a released position to a rod trapping position when engaged by said rods on said modules.

13. The system of claim 6 wherein said base has a module receiving surface and a vertically swingably mounted lift device is swingable upwardly from an inoperative to an operative position for raising the portion of a module adjacent said base above said surface; said lift device having a locking element receivable by said base locking element to releasably lock said lift device in position.

14. The system of claim 6 wherein said connector assemblies have guides vertically slidable on said posts mounting said modules for sliding movement on said posts.

15. The system of claim 14 wherein one of said locking elements for the rearmost module in said train disengageably connects said rearmost module to said base locking element.

16. A method of disassembling and removing a dock system comprising a shore base carrying disengageable locking elements for receiving and retaining a dock on a front end thereof; a train of dock module components extending forwardly from said base; said module components comprising floatable modules with connector assemblies at the ends of said modules; laterally spaced posts, with lake bed engaging dock supporting base parts, on which said module components are vertically slidably received to be movable from a lower position in which said modules float to a raised position in which said modules are safely above the water; disengagable mechanism for holding said module components in raised position; disengageable locking elements on said connector assemblies and modules to retain said modules coupled in train disposition; and a module transport device operable to engage and move said modules sequentially forwardly to form a train as said modules are sequentially locked or to move said modules sequentially rearwardly to detrain them and remove them to shore as said modules are sequentially unlocked; said method comprising:

a. disengaging said mechanism for holding said module components in raised position above the water and permitting them to lower to float;

b. unlocking said dock module adjacent said base and engaging said transport device with said adjacent module to move said adjacent module and train rearwardly to bring said adjacent module onto said base and said other modules closer to shore;

c. unlocking said adjacent module from said next adjacent module; and engaging said transport device with said next adjacent module to move said next adjacent module and remaining modules in said train rearwardly to bring said next adjacent module to said base and said remaining modules closer to shore; and d. repeating part c, as required, for said remaining modules.

17. The method of claim 16 wherein said connector assemblies have guides mounting said module components for vertical movement along said posts and said connector assemblies have said disengageable locking elements at front and rear; and said method includes decoupling said adjacent module from said base locking elements and engaging said module transport device with said adjacent module to move it rearwardly to disengage said locking elements on the base and adjacent module prior to moving said adjacent module rearwardly across said base and said train of modules rearwardly to a position closer to said base.

18. The method of claim 17 wherein connector assemblies at the front of said next adjacent dock module are disconnected from said next adjacent dock module and removed prior to moving said next adjacent dock module rearwardly across said base.

19. A method of assembling a dock system comprising a shore base carrying a disengageable locking element for receiving and retaining a dock on a front end thereof; a train of floatable dock module components extending forwardly from said base: said module components comprising floatable modules incorporating connector assemblies at the ends of said modules with laterally spaced posts with lake bottom engaging dock supporting base parts on which said module components are vertically slidably received to be movable from a lower position in which said modules float to a raised position in which said modules are well above the water; disengagable mechanism for holding said modules in raised position; and disengageable locking elements on said connector assemblies for disengageably coupling with locking elements on said modules to retain said modules coupled in train disposition; and a module transport device operable to support a module and move said modules sequentially forwardly to form a train as said modules are sequentially locked to said module supporting connector assemblies; the method comprising:

a. moving a module to be foremost in said train forwardly to be supported by said transport device and attaching a connector assembly to the rear end of said module to be foremost in said train;

b. supporting said module to be foremost while a next foremost module is disengageably locked to the rear end of said module to be foremost;

c. operating said transport device to move said next foremost module forwardly to a position in which it can be supported while a connector assembly is attached and said module to be foremost can float;

d. repeating parts b and c with respect to subsequent modules to form the train desired:

e. coupling said train to said base locking elements; and f. raising each module from a floating position on said posts to a position safely above said water level and retaining said modules in raised position.

20. The method of claim 19 wherein said base is provided as a station upon which said modules are stacked in the order removed in an overhead stack and lift platform is raiseable to receive and lower the undermost module in said stack, and the method includes operating said lift platform to sequentially lower said modules to a position in which they can be sequentially moved forwardly to be engaged by said transport device.

21. A dock system for lakes and other bodies of water adapted to extend from a shore base out into the body of water comprising:

a. a train of floatable dock modules having confronting front and rear ends forming a walkway extending forwardly from a retained position on shore;

b. connector assemblies having post guides and forwardly and rearwardly extending disengageable coupling mechanisms disengageably coupling to said ends of adjacent pairs of said modules to retain said modules coupled in train disposition;

c. laterally spaced posts, with lake bed engaging base parts, on which said connector assemblies guide and said connector assemblies are vertically slideably received to be movable from a lower position on said posts in which said modules float to a raised position on said posts in which said modules are safely above the water; and d. disengageable retention mechanism for retaining said modules in said raised position.

22. The system of claim 21 wherein said coupling mechanisms react with coupling elements provided on said modules to automatically lock said modules to said connector assemblies when said modules come into operative engagement with them.

23. The system of claim 22 wherein said coupling elements on said modules comprise laterally projecting parts and said coupling mechanisms include front and rear locking elements comprising receiving jaws with part receiving sockets; and pivotal latches, with part trapping arms having camming surfaces thereon, pivotally mounted to be pivoted from a released position to a rod trapping position when said camming surfaces are engaged by said projecting parts on said modules.

* * * * *